US009700991B2

(12) United States Patent
Smith et al.

(10) Patent No.: US 9,700,991 B2
(45) Date of Patent: Jul. 11, 2017

(54) METHODS OF FORMING EARTH-BORING TOOLS INCLUDING SINTERBONDED COMPONENTS

(71) Applicant: Baker Hughes Incorporated, Houston, TX (US)

(72) Inventors: Redd H. Smith, Salt Lake City, UT (US); Nicholas J. Lyons, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 14/874,639

(22) Filed: Oct. 5, 2015

(65) Prior Publication Data

US 2016/0023327 A1 Jan. 28, 2016

Related U.S. Application Data

(62) Division of application No. 14/325,056, filed on Jul. 7, 2014, now Pat. No. 9,192,989, which is a division (Continued)

(51) Int. Cl.
*B24D 3/00* (2006.01)
*E21B 10/55* (2006.01)

(Continued)

(52) U.S. Cl.
CPC ..... *B24D 3/007* (2013.01); *B22F 3/10* (2013.01); *B22F 3/1017* (2013.01); *B22F 7/06* (2013.01);

(Continued)

(58) Field of Classification Search
CPC B22F 2999/00; B22F 3/1017; B22F 2207/17; B22F 2005/002; B22F 3/10;

(Continued)

(56) References Cited

U.S. PATENT DOCUMENTS 1,954,166 A 4/1934 Campbell
2,299,207 A 10/1942 Bevillard (Continued)

FOREIGN PATENT DOCUMENTS

AU 695583 B2 8/1998
CA 2212197 A1 2/1998

(Continued)

OTHER PUBLICATIONS

US 4,966,627, 10/1990, Keshavan et al. (withdrawn)

(Continued)

*Primary Examiner* — James G Sayre
(74) *Attorney, Agent, or Firm* — TraskBritt

(57) ABSTRACT

Partially formed earth-boring rotary drill bits comprise a first less than fully sintered particle-matrix component having at least one recess, and at least a second less than fully sintered particle-matrix component disposed at least partially within the at least one recess. Each less than fully sintered particle-matrix component comprises a green or brown structure including compacted hard particles, particles comprising a metal alloy matrix material, and an organic binder material. The at least a second less than fully sintered particle-matrix component is configured to shrink at a slower rate than the first less than fully sintered particle-matrix component due to removal of organic binder material from the less than fully sintered particle-matrix components in a sintering process to be used to sinterbond the first less than fully sintered particle-matrix component to the at least a second less than fully sintered particle-matrix component. Earth-boring rotary drill bits comprise such components sinterbonded together.

20 Claims, 16 Drawing Sheets

Related U.S. Application Data of application No. 12/136,703, filed on Jun. 10, 2008, now Pat. No. 8,770,324.

(51) Int. Cl.

| | |
|---|---|
| ***B24D 18/00*** | (2006.01) |
| ***B24D 3/20*** | (2006.01) |
| ***B22F 7/06*** | (2006.01) |
| ***B22F 3/10*** | (2006.01) |
| ***E21B 10/00*** | (2006.01) |
| ***E21B 10/54*** | (2006.01) |
| *B22F 5/00* | (2006.01) |

(52) U.S. Cl.

CPC ..... *B22F 7/062* (2013.01); *B24D 3/20* (2013.01); *B24D 18/0009* (2013.01); *E21B 10/00* (2013.01); *E21B 10/54* (2013.01); *E21B 10/55* (2013.01); *B22F 2005/002* (2013.01); *B22F 2999/00* (2013.01)

(58) Field of Classification Search

CPC ..... B22F 7/06; B22F 7/062; B24D 18/0009; B24D 3/007; B24D 3/20; E21B 10/00; E21B 10/54; E21B 10/55

See application file for complete search history.

(56) References Cited

U.S. PATENT DOCUMENTS 2,507,439 A 5/1950 Goolsbee
2,819,958 A 1/1958 Abkowitz et al.
2,819,959 A 1/1958 Abkowitz et al.
2,906,654 A 9/1959 Abkowitz et al.
3,368,881 A 2/1968 Abkowitz et al.
3,471,921 A * 10/1969 Feenstra ..... B23K 35/3006 228/124.1
3,660,050 A 5/1972 Iler et al.
3,757,879 A 9/1973 Wilder et al.
3,859,016 A * 1/1975 McGee ..... B22F 7/06 425/130
3,880,971 A 4/1975 Pantanelli et al.
3,987,859 A 10/1976 Lichte
4,017,480 A 4/1977 Baum et al.
4,047,828 A 9/1977 Makely
4,094,709 A 6/1978 Rozmus et al.
4,128,136 A 12/1978 Generoux
4,134,759 A 1/1979 Yajima et al.
4,157,122 A 6/1979 Morris
4,198,233 A 4/1980 Frehn
4,221,270 A 9/1980 Vezirian
4,229,638 A 10/1980 Lichte et al.
4,233,720 A 11/1980 Rozmus et al.
4,252,202 A 2/1981 Purser
4,255,165 A 3/1981 Dennis et al.
4,306,139 A 12/1981 Shinozaki et al.
4,341,557 A 7/1982 Lizenby
4,389,952 A 6/1983 Dreier et al.
4,398,952 A 8/1983 Drake et al.
4,453,605 A 6/1984 Short, Jr.
4,499,048 A 2/1985 Hanejko
4,499,795 A 2/1985 Radtke
4,499,958 A 2/1985 Radtke et al.
4,503,009 A 3/1985 Asaka
4,526,748 A 7/1985 Rozmus et al.
4,547,337 A 10/1985 Rozmus et al.
4,552,232 A 11/1985 Frear
4,554,130 A * 11/1985 Ecer ..... B22F 3/15 419/36
4,562,990 A 1/1986 Rose
4,596,694 A 6/1986 Rozmus
4,597,730 A 7/1986 Rozmus
4,620,600 A 11/1986 Persson
4,630,693 A 12/1986 Goodfellow
4,656,002 A 4/1987 Lizenby et al.
4,667,756 A 5/1987 King et al.
4,686,080 A 8/1987 Hara et al.
4,694,919 A 9/1987 Barr
4,738,322 A 4/1988 Hall et al.
4,743,515 A 5/1988 Fischer et al.
4,744,943 A 5/1988 Timm et al.
4,774,211 A 9/1988 Hamilton et al.
4,809,903 A 3/1989 Eylon et al.
4,838,366 A 6/1989 Jones
4,871,377 A 10/1989 Frushour
4,881,431 A 11/1989 Bieneck
4,884,477 A 12/1989 Smith et al.
4,889,017 A 12/1989 Fuller et al.
4,919,013 A 4/1990 Smith et al.
4,923,512 A 5/1990 Timm et al.
4,956,012 A 9/1990 Jacobs et al.
4,968,348 A 11/1990 Abkowitz et al.
4,981,665 A 1/1991 Boecker et al.
5,000,273 A 3/1991 Horton et al.
5,030,598 A 7/1991 Hsieh
5,032,352 A 7/1991 Meeks et al.
5,049,450 A 9/1991 Dorfman
5,090,491 A 2/1992 Tibbitts et al.
5,101,692 A 4/1992 Simpson
5,150,636 A 9/1992 Hill
5,161,898 A 11/1992 Drake
5,232,522 A 8/1993 Doktycz et al.
5,281,260 A 1/1994 Kumar
5,286,685 A 2/1994 Schoennahl et al.
5,311,958 A 5/1994 Isbell
5,322,139 A 6/1994 Rose et al.
5,333,699 A 8/1994 Thigpen
5,348,806 A 9/1994 Kojo et al.
5,372,777 A * 12/1994 Yang ..... B22D 19/14 164/71.1
5,373,907 A 12/1994 Weaver
5,433,280 A 7/1995 Smith
5,439,068 A 8/1995 Huffstutler et al.
5,439,608 A 8/1995 Kondrats
5,443,337 A 8/1995 Katayama
5,455,000 A 10/1995 Seyferth et al.
5,467,669 A 11/1995 Stroud et al.
5,479,997 A 1/1996 Scott et al.
5,482,670 A 1/1996 Hong
5,484,468 A 1/1996 Oestlund et al.
5,506,055 A 4/1996 Dorfman et al.
5,541,006 A * 7/1996 Conley ..... B22F 7/06 419/12
5,543,235 A 8/1996 Mirchandani et al.
5,544,550 A 8/1996 Smith
5,560,440 A 10/1996 Tibbitts et al.
5,586,612 A 12/1996 Isbell et al.
5,593,474 A 1/1997 Keshavan et al.
5,611,251 A 3/1997 Katayama
5,612,264 A 3/1997 Nilsson et al.
5,624,002 A 4/1997 Huffstutler
5,641,029 A 6/1997 Beaton et al.
5,641,251 A 6/1997 Leins et al.
5,641,921 A 6/1997 Dennis et al.
5,662,183 A 9/1997 Fang
5,666,864 A 9/1997 Tibbitts
5,677,042 A 10/1997 Massa et al.
5,679,445 A 10/1997 Massa et al.
5,696,694 A 12/1997 Khouja et al.
5,697,046 A 12/1997 Conley
5,697,462 A 12/1997 Grimes et al.
5,710,969 A 1/1998 Newman
5,725,827 A 3/1998 Rhodes et al.
5,732,783 A 3/1998 Truax et al.
5,733,649 A 3/1998 Kelley et al.
5,733,664 A 3/1998 Kelley et al.
5,740,872 A 4/1998 Smith
5,753,160 A 5/1998 Takeuchi et al.
5,765,095 A 6/1998 Flak et al.
5,776,593 A 7/1998 Massa et al.
5,778,301 A 7/1998 Hong et al.
5,789,686 A 8/1998 Massa et al.
5,792,403 A 8/1998 Massa et al.
5,806,934 A 9/1998 Massa et al.

(56) References Cited

U.S. PATENT DOCUMENTS 5,829,539 A 11/1998 Newton et al.
5,830,256 A 11/1998 Northrop et al.
5,856,626 A 1/1999 Fischer et al.
5,865,571 A 2/1999 Tankala et al.
5,878,634 A 3/1999 Tibbits
5,880,382 A 3/1999 Fang et al.
5,897,830 A 4/1999 Abkowitz et al.
5,904,212 A 5/1999 Arfele
5,947,214 A 9/1999 Tibbitts et al.
5,957,006 A 9/1999 Smith
5,963,775 A 10/1999 Fang et al.
5,967,248 A 10/1999 Drake et al.
5,980,602 A 11/1999 Carden
6,029,544 A 2/2000 Katayama
6,045,750 A 4/2000 Drake et al.
6,051,171 A * 4/2000 Takeuchi ..... C04B 35/111 264/40.1
6,063,333 A 5/2000 Dennis et al.
6,068,070 A 5/2000 Scott
6,073,518 A 6/2000 Chow et al.
6,086,980 A 7/2000 Foster et al.
6,089,123 A 7/2000 Chow et al.
6,099,664 A 8/2000 Davies et al.
6,135,218 A 10/2000 Deane et al.
6,148,936 A 11/2000 Evans et al.
6,200,514 B1 3/2001 Meister
6,209,420 B1 4/2001 Butcher et al.
6,214,134 B1 4/2001 Eylon et al.
6,214,287 B1 4/2001 Waldenstrom et al.
6,220,117 B1 4/2001 Butcher
6,227,188 B1 5/2001 Tankala et al.
6,228,139 B1 5/2001 Oskarsson et al.
6,241,036 B1 6/2001 Lovato et al.
6,254,658 B1 7/2001 Taniuchi et al.
6,284,014 B1 9/2001 Carden
6,287,360 B1 9/2001 Kembaiyan et al.
6,290,438 B1 9/2001 Papajewski et al.
6,293,986 B1 9/2001 Rodiger et al.
6,322,746 B1 * 11/2001 LaSalle ..... A63B 53/0487 264/645
6,338,390 B1 1/2002 Tibbitts
6,348,110 B1 2/2002 Evans
6,375,706 B2 4/2002 Kembaiyan et al.
6,408,958 B1 6/2002 Isbell et al.
6,453,899 B1 9/2002 Tselesin
6,454,025 B1 9/2002 Runquist et al.
6,454,028 B1 9/2002 Evans
6,454,030 B1 9/2002 Findley et al.
6,458,471 B2 10/2002 Lovato et al.
6,474,424 B1 11/2002 Saxman
6,474,425 B1 11/2002 Truax et al.
6,500,226 B1 12/2002 Dennis
6,511,265 B1 1/2003 Mirchandani et al.
6,576,182 B1 6/2003 Ravagni et al.
6,589,640 B2 7/2003 Griffin et al.
6,599,467 B1 7/2003 Yamaguchi et al.
6,607,693 B1 8/2003 Saito et al.
6,615,935 B2 9/2003 Fang et al.
6,651,481 B1 11/2003 Youngquist
6,651,756 B1 11/2003 Costo, Jr. et al.
6,655,481 B2 12/2003 Findley et al.
6,685,880 B2 2/2004 Engstrom et al.
6,742,608 B2 6/2004 Murdoch
6,742,611 B1 6/2004 Illerhaus et al.
6,756,009 B2 6/2004 Sim et al.
6,766,870 B2 7/2004 Overstreet
6,849,231 B2 2/2005 Kojima
6,908,688 B1 6/2005 Majagi et al.
6,918,942 B2 7/2005 Hatta et al.
7,044,243 B2 5/2006 Kembaiyan et al.
7,048,081 B2 5/2006 Smith et al.
7,395,882 B2 7/2008 Oldham et al.
7,513,320 B2 4/2009 Mirchandani et al.
7,776,256 B2 8/2010 Smith et al.
7,802,495 B2 9/2010 Oxford et al.
7,807,099 B2 10/2010 Choe et al.
7,954,569 B2 6/2011 Mirchandani et al.
8,309,018 B2 11/2012 Smith et al.
2001/0000591 A1 5/2001 Tibbitts
2001/0008190 A1 7/2001 Scott et al.
2002/0004105 A1 1/2002 Kunze et al.
2003/0010409 A1 1/2003 Kunze et al.
2003/0079916 A1 5/2003 Oldham et al.
2004/0007393 A1 1/2004 Griffin
2004/0013558 A1 1/2004 Kondoh et al.
2004/0040750 A1 3/2004 Griffo et al.
2004/0060742 A1 4/2004 Kembaiyan et al.
2004/0065481 A1 4/2004 Murdoch
2004/0141865 A1 7/2004 Keshavan et al.
2004/0196638 A1 * 10/2004 Lee ..... B32B 18/00 361/765
2004/0243241 A1 12/2004 Istephanous et al.
2004/0245022 A1 * 12/2004 Izaguirre ..... B22F 7/06 175/374
2004/0245024 A1 * 12/2004 Kembaiyan ..... B22F 7/06 175/425
2005/0008524 A1 1/2005 Testani
2005/0072496 A1 4/2005 Hwang et al.
2005/0072601 A1 4/2005 Griffo et al.
2005/0084407 A1 4/2005 Myrick
2005/0117984 A1 6/2005 Eason et al.
2005/0126334 A1 6/2005 Mirchandani
2005/0211474 A1 9/2005 Nguyen et al.
2005/0211475 A1 9/2005 Mirchandani et al.
2005/0220658 A1 10/2005 Olsson et al.
2005/0247491 A1 11/2005 Mirchandani et al.
2005/0268746 A1 12/2005 Abkowitz et al.
2006/0016521 A1 1/2006 Hanusiak et al.
2006/0032677 A1 2/2006 Azar et al.
2006/0043648 A1 3/2006 Takeuchi et al.
2006/0057017 A1 3/2006 Woodfield et al.
2006/0131081 A1 6/2006 Mirchandani et al.
2006/0185908 A1 * 8/2006 Kembaiyan ..... E21B 10/54 175/425
2006/0231293 A1 10/2006 Ladi et al.
2007/0042217 A1 2/2007 Fang et al.
2007/0102198 A1 5/2007 Oxford et al.
2007/0102199 A1 5/2007 Smith et al.
2007/0102200 A1 5/2007 Choe et al.
2007/0202000 A1 8/2007 Andrees et al.
2007/0227782 A1 10/2007 Kirk et al.
2008/0053709 A1 3/2008 Lockstedt et al.
2008/0101977 A1 * 5/2008 Eason ..... B22F 7/062 419/38
2008/0202814 A1 8/2008 Lyons et al.
2009/0031863 A1 2/2009 Lyons et al.
2009/0044663 A1 2/2009 Stevens et al.

FOREIGN PATENT DOCUMENTS

EP 264674 A2 9/1995
EP 453428 A1 1/1997
EP 995876 A2 9/2004
EP 1244531 B1 10/2004
GB 945227 A 12/1963
GB 2017153 A * 10/1979 ..... B22F 7/062
GB 2203774 A 10/1988
GB 2345930 A 7/2000
GB 2385350 A 8/2003
GB 2393449 A 3/2004
JP 10219385 A 8/1998
WO 03049889 A2 6/2003
WO 2004053197 A2 6/2004

OTHER PUBLICATIONS

Alman D.E. et al. "The Abrasive Wear of Sintered Titanium Matrix-Ceramic Particle Reinforced Composites" WEAR 225-229 (1999) pp. 629-639.

"Boron Carbide Nozzles and Inserts" Seven Stars International webpage http://www.concentric.net/~ctkang/nozzle.shtml printed Sep. 7, 2006.

(56) References Cited

OTHER PUBLICATIONS

Choe Heeman et al. "Effect of Tungsten Additions on the Mechanical Properties of Ti-6A1-4V" Material Science and Engineering A 396 (2005) pp. 99-106 Elsevier.
Diamond Innovations "Composite Diamond Coatings Superhard Protection of Wear Parts New Coating and Service Parts from Diamond Innovations" brochure 2004.
Gale W.F. et al. Smithells Metals Reference Book Eighth Edition 2003 p. 2117 Elsevier Butterworth Heinemann.
"Heat Treating of Titanium and Titanium Alloys" Key to Metals website article www.key-to-metals.com, visited Sep. 21, 2006).
Miserez A. et al. "Particle Reinforced Metals of High Ceramic Content" Material Science and Engineering A 387-389 (2004) pp. 822-831 Elsevier.
Reed James S. "Chapter 13: Particle Packing Characteristics" Principles of Ceramics Processing Second Edition John Wiley & Sons Inc. (1995) pp. 215-227.
Warrier S.G. et al. "Infiltration of Titanium Alloy-Matrix Composites" Journal of Materials Science Letters 12 (1993) pp. 865-868 Chapman & Hall.
U.S. Appl. No. 60/566,063, filed Apr. 28, 2004 entitled "Body Materials for Earth Boring Bits" to Mirchandani et al.
International Search Report for International Application No. PCT/US2009/046812 dated Jan. 26, 2010 5 pages.
Written Opinion for International Application No. PCT/US2009/046812 dated Jan. 26, 2010 5 pages.
International Preliminary Report on Patentability for International Application No. PCT/US2009/046812 dated Dec. 13, 2010, 8 pages.
Serway Raymond A. Principles of Physics p. 445 (2d Ed. 1998).
Supplemental European Search Report for European Application No. 09763485 completion date Jul. 12, 2013, 6 pages.

* cited by examiner

METHODS OF FORMING EARTH-BORING TOOLS INCLUDING SINTERBONDED COMPONENTS

CROSS-REFERENCE TO RELATED APPLICATIONS

This application is a divisional of U.S. patent application Ser. No. 14/325,056, filed Jul. 7, 2014, now U.S. Pat. No. 9,192,989, issued Nov. 24, 2015; which is a divisional of U.S. patent application Ser. No. 12/136,703, filed Jun. 10, 2008, now U.S. Pat. No. 8,770,324, issued Jul. 8, 2014, the disclosure of each of which is hereby incorporated herein in its entirety by this reference. The subject matter of this application is related to the subject matter of U.S. application Ser. No. 11/272,439, filed Nov. 10, 2005, now U.S. Pat. No. 7,776,256, issued Aug. 17, 2010 and U.S. application Ser. No. 11/271,153, filed Nov. 10, 2005, now U.S. Pat. No. 7,802,495, issued Sep. 28, 2010, the disclosure of each of which is hereby incorporated herein in its entirety by this reference. The subject matter of this application is also related to U.S. application Ser. No. 12/831,608, filed Jul. 7, 2010, pending and U.S. application Ser. No. 12/827,968, filed Jun. 30, 2010, now U.S. Pat. No. 8,309,018, issued Nov. 13, 2012, the disclosure of each of which is hereby incorporated herein in its entirety by this reference.

FIELD

The present invention generally relates to earth-boring drill bits and other earth-boring tools that may be used to drill subterranean formations, and to methods of manufacturing such drill bits and tools. More particularly, the present invention relates to methods of sinterbonding components together to form at least a portion of an earth-boring tool and to tools formed using such methods.

BACKGROUND

The depth of well bores being drilled continues to increase as the number of shallow depth hydrocarbon-bearing earth formations continues to decrease. These increasing well bore depths are pressing conventional drill bits to their limits in terms of performance and durability. Several drill bits are often required to drill a single well bore, and changing a drill bit on a drill string can be both time consuming and expensive.

In efforts to improve drill bit performance and durability, new materials and methods for forming drill bits and their various components are being investigated. For example, methods other than conventional infiltration processes are being investigated to form bit bodies comprising particle-matrix composite materials. Such methods include forming bit bodies using powder compaction and sintering techniques. The term "sintering," as used herein, means the densification of a particulate component and involves removal of at least a portion of the pores between the starting particles, accompanied by shrinkage, combined with coalescence and bonding between adjacent particles. Such techniques are disclosed in U.S. patent application Ser. No. 11/271,153, filed Nov. 10, 2005, now U.S. Pat. No. 7,802,495, issued Sep. 28, 2010, and U.S. patent application Ser. No. 11/272,439, also filed Nov. 10, 2005, now U.S. Pat. No. 7,776,256, issued Aug. 17, 2010, both of which are assigned to the assignee of the present invention, and the entire disclosure of each of which is incorporated herein by this reference.

An example of a bit body 50 that may be formed using such powder compaction and sintering techniques is illustrated in FIG. 1. The bit body 50 may be predominantly comprised of a particle-matrix composite material 54. As shown in FIG. 1, the bit body 50 may include wings or blades 58 that are separated by junk slots 60, and a plurality of PDC cutting elements 62 (or any other type of cutting element) may be secured within cutting element pockets 64 on a face 52 of the bit body 50. The PDC cutting elements 62 may be supported from behind by buttresses 66, which may be integrally formed with the bit body 50. The bit body 50 may include internal fluid passageways (not shown) that extend between the face 52 of the bit body 50 and a longitudinal bore 56, which extends through the bit body 50. Nozzle inserts (not shown) also may be provided at the face 52 of the bit body 50 within the internal fluid passageways.

An example of a manner in which the bit body 50 may be formed using powder compaction and sintering techniques is described briefly below.

Referring to FIG. 2A, a powder mixture 68 may be pressed (e.g., with substantially isostatic pressure) within a mold or container 74. The powder mixture 68 may include a plurality of hard particles and a plurality of particles comprising a matrix material. Optionally, the powder mixture 68 may further include additives commonly used when pressing powder mixtures such as, for example, organic binders for providing structural strength to the pressed powder component, plasticizers for making the organic binder more pliable, and lubricants or compaction aids for reducing inter-particle friction and otherwise providing lubrication during pressing.

The container 74 may include a fluid-tight deformable member 76 such as, for example, a deformable polymeric bag and a substantially rigid sealing plate 78. Inserts or displacement members 79 may be provided within the container 74 for defining features of the bit body 50 such as, for example, a longitudinal bore 56 (FIG. 1) of the bit body 50. The sealing plate 78 may be attached or bonded to the deformable member 76 in such a manner as to provide a fluid-tight seal therebetween.

The container 74 (with the powder mixture 68 and any desired displacement members 79 contained therein) may be pressurized within a pressure chamber 70. A removable cover 71 may be used to provide access to the interior of the pressure chamber 70. A fluid (which may be substantially incompressible) such as, for example, water, oil, or gas (such as, for example, air or nitrogen) is pumped into the pressure chamber 70 through an opening 72 at high pressures using a pump (not shown). The high pressure of the fluid causes the walls of the deformable member 76 to deform, and the fluid pressure may be transmitted substantially uniformly to the powder mixture 68.

Pressing of the powder mixture 68 may form a green (or unsintered) body 80 shown in FIG. 2B, which can be removed from the pressure chamber 70 and container 74 after pressing.

The green body 80 shown in FIG. 2B may include a plurality of particles (hard particles and particles of matrix material) held together by interparticle friction forces and an organic binder material provided in the powder mixture 68 (FIG. 2A). Certain structural features may be machined in the green body 80 using conventional machining techniques including, for example, turning techniques, milling techniques, and drilling techniques. Hand held tools also may be used to manually form or shape features in or on the green body 80. By way of example and not limitation, blades 58, junk slots 60 (FIG. 1), and other features may be machined or otherwise formed in the green body 80 to form a partially shaped green body 84 shown in FIG. 2C.

The partially shaped green body 84 shown in FIG. 2C may be at least partially sintered to provide a brown (partially sintered) body 90 shown in FIG. 2D, which has less than a desired final density. Partially sintering the green body 84 to form the brown body 90 may cause at least some of the plurality of particles to have at least partially grown together to provide at least partial bonding between adjacent particles. The brown body 90 may be machinable due to the remaining porosity therein. Certain structural features also may be machined in the brown body 90 using conventional machining techniques.

By way of example and not limitation, internal fluid passageways (not shown), cutting element pockets 64, and buttresses 66 (FIG. 1) may be machined or otherwise formed in the brown body 90 to form a brown body 96 shown in FIG. 2E. The brown body 96 shown in FIG. 2E then may be fully sintered to a desired final density, and the cutting elements 62 may be secured within the cutting element pockets 64 to provide the bit body 50 shown in FIG. 1.

In other methods, the green body 80 shown in FIG. 2B may be partially sintered to form a brown body without prior machining, and all necessary machining may be performed on the brown body prior to fully sintering the brown body to a desired final density. Alternatively, all necessary machining may be performed on the green body 80 shown in FIG. 2B, which then may be fully sintered to a desired final density.

BRIEF SUMMARY

In some embodiments, the present invention includes methods of forming earth-boring rotary drill bits by forming and joining two less than fully sintered components, by forming and joining a first fully sintered component with a first shrink rate and forming a second less than fully sintered component with a second sinter-shrink rate greater than that of the first shrink rate of the first fully sintered component, by forming and joining a first less than fully sintered component with a first sinter-shrink rate and by forming and joining at least a second less than fully sintered component with a second sinter-shrink rate less than the first sinter-shrink rate. The methods include co-sintering a first less than fully sintered component and a second less than fully sintered component to a desired final density to form at least a portion of an earth-boring rotary drill bit, which may either cause the first less than fully sintered component and the second less than fully sintered component to join or may cause one of the first less than fully sintered component and the second less than fully sintered component to shrink around and at least partially capture the other less than fully sintered component.

In additional embodiments, the present invention includes methods of forming earth-boring rotary drill bits by providing a first component with a first sinter-shrink rate, placing at least a second component with a second sinter-shrink rate less than the first sinter-shrink rate at least partially within at least a first recess of the first component, and causing the first component to shrink at least partially around and bond to the at least a second component by co-sintering the first component and the at least a second component.

In yet additional embodiments, the present invention includes methods of forming earth-boring rotary drill bits by tailoring the sinter-shrink rate of a first component to be greater than the sinter-shrink rate of at least a second component and co-sintering the first component and the at least a second component to cause the first component to at least partially contract upon and bond to the at least a second component.

In other embodiments, the present invention includes earth-boring rotary drill bits including a first particle-matrix component and at least a second particle-matrix component at least partially surrounded by and sinterbonded to the first particle-matrix component.

In additional embodiments, the present invention includes earth-boring rotary drill bits including a bit body comprising a particle-matrix composite material and at least one cutting structure comprising a particle-matrix composite material sinterbonded at least partially within at least one recess of the bit body.

BRIEF DESCRIPTION OF THE DRAWINGS

While the specification concludes with claims particularly pointing out and distinctly claiming that which is regarded as the present invention, the advantages of this invention may be more readily ascertained from the description of the invention when read in conjunction with the accompanying drawings, in which:

DETAILED DESCRIPTION

The illustrations presented herein are not meant to be actual views of any particular material, apparatus, system, or method, but are merely idealized representations which are employed to describe the present invention. Additionally, elements common between figures may retain the same numerical designation.

Figure 3:
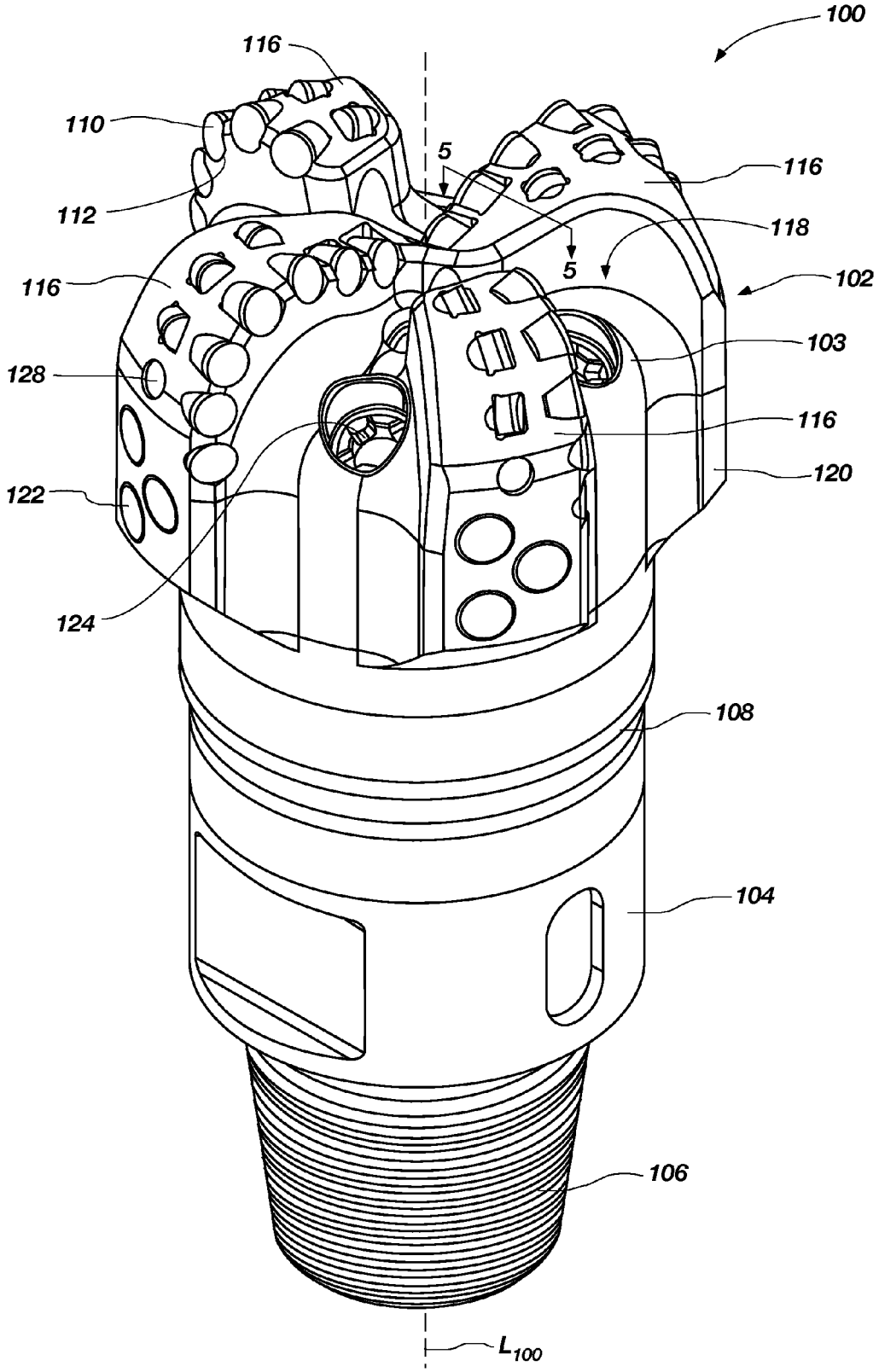
FIG. 3 is a perspective view of one embodiment of an earth-boring rotary drill bit of the present invention that includes two or more sinterbonded components.
Figure 4:
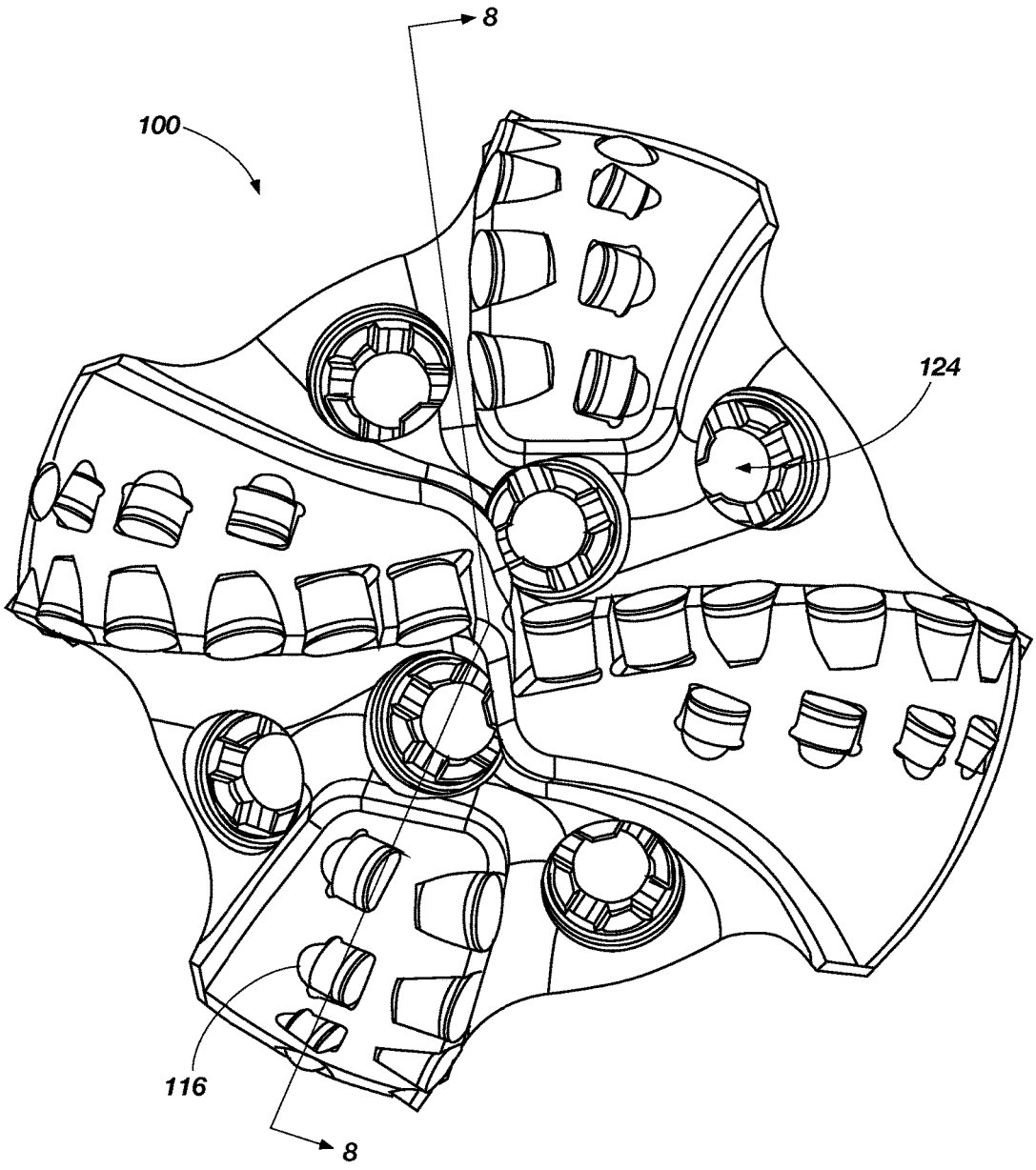
FIG. 4 is a plan view of the face of the earth-boring rotary drill bit shown in FIG. 3.

An embodiment of an earth-boring rotary drill bit 100 of the present invention is shown in perspective in FIG. 3. FIG. 4 is a top plan view of the face of the earth-boring rotary drill bit 100 shown in FIG. 3. The earth-boring rotary drill bit 100 may comprise a bit body 102 that is secured to a shank 104 having a threaded connection portion 106 (e.g., an American Petroleum Institute (API) threaded connection portion) for attaching the drill bit 100 to a drill string (not shown). In some embodiments, such as that shown in FIG. 3, the bit body 102 may be secured to the shank 104 using an extension 108. In other embodiments, the bit body 102 may be secured directly to the shank 104.

Figure 1:
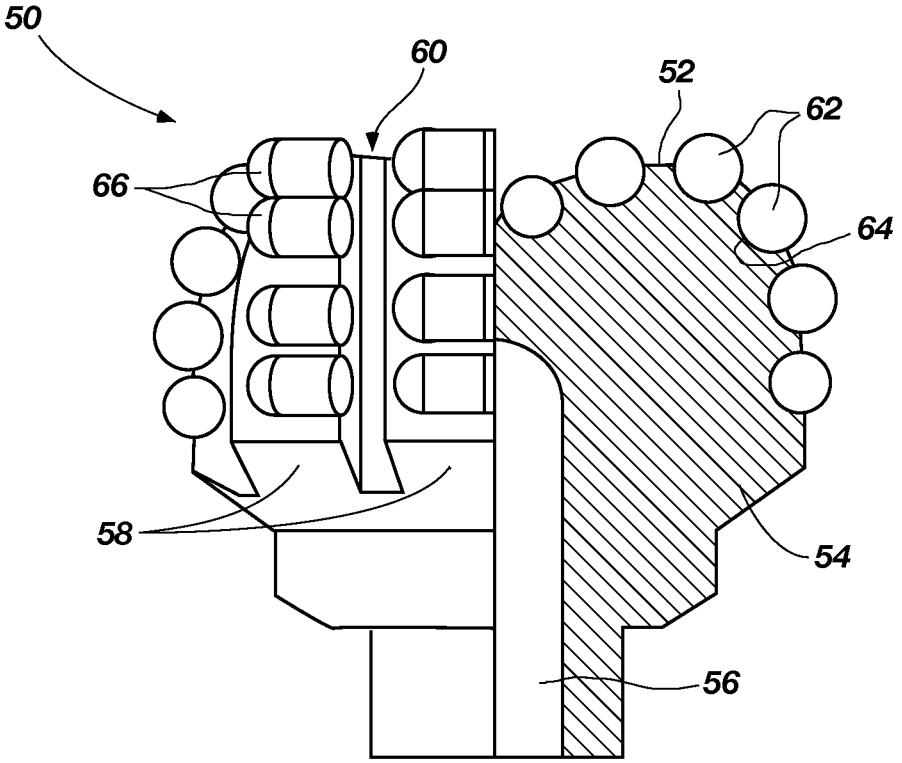
FIG. 1 (PRIOR ART)
FIG. 1 is a partial longitudinal cross-sectional view of a bit body of an earth-boring rotary drill bit that may be formed using powder compaction and sintering processes.
Figure 2A:
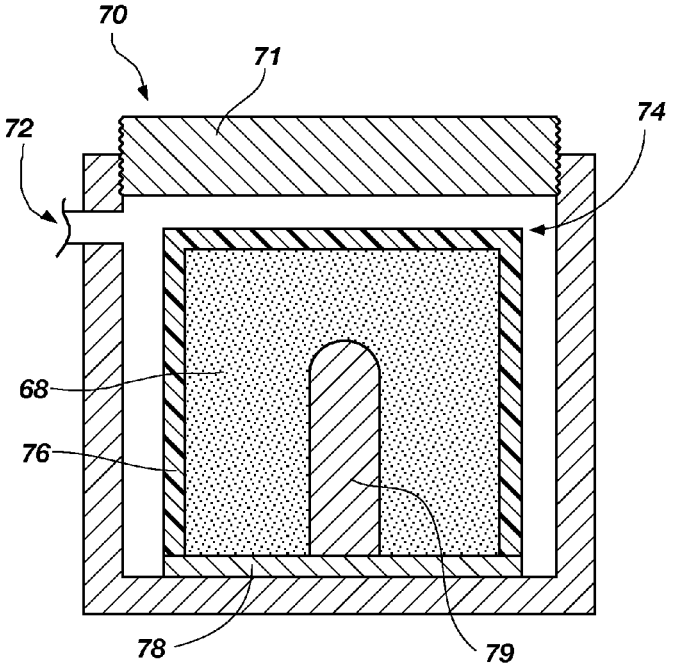
FIG. 2A (PRIOR ART)
FIGS. 2A-2E illustrate an example of a particle compaction and sintering process that may be used to form the bit body shown in FIG. 1.
Figure 2B:
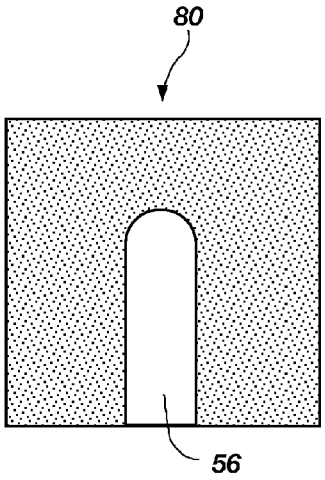
FIG. 2B (PRIOR ART)
Figure 2C:
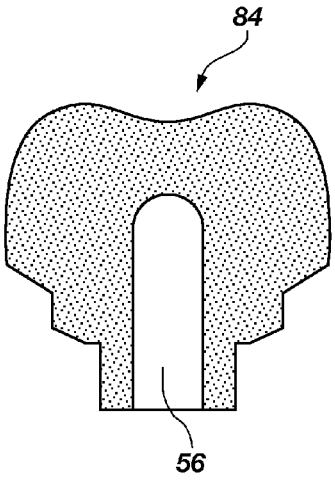
FIG. 2C (PRIOR ART)
Figure 2D:
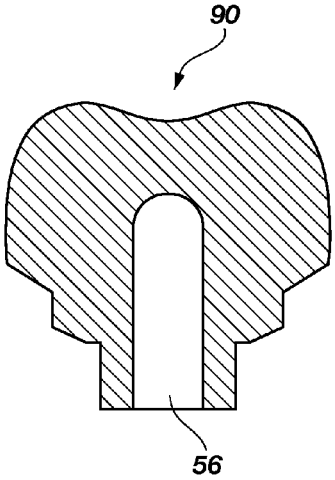
FIG. 2D (PRIOR ART)
Figure 2E:
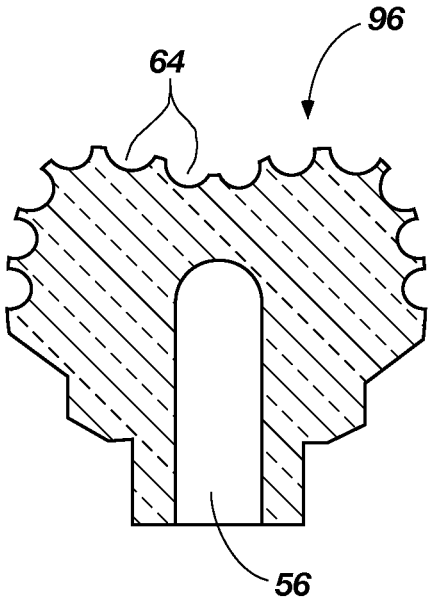
FIG. 2E (PRIOR ART)

The bit body 102 may include internal fluid passageways (not shown) that extend between a face 103 of the bit body 102 and a longitudinal bore (not shown), which extends through the shank 104, the extension 108, and partially through the bit body 102, similar to the longitudinal bore 56 shown in FIG. 1. Nozzle inserts 124 also may be provided at the face 103 of the bit body 102 within the internal fluid passageways. The bit body 102 may further include a plurality of blades 116 that are separated by junk slots 118. In some embodiments, the bit body 102 may include gage wear plugs 122 and wear knots 128. A plurality of cutting elements 110 (which may include, for example, PDC cutting elements) may be mounted on the face 103 of the bit body 102 in cutting element pockets 112 that are located along each of the blades 116.

The earth-boring rotary drill bit 100 shown in FIG. 3 may comprise a particle-matrix composite material 120 and may be formed using powder compaction and sintering processes, such as those described in previously mentioned U.S. patent application Ser. No. 11/271,153, filed Nov. 10, 2005, now U.S. Pat. No. 7,802,495, issued Sep. 28, 2010, and U.S. patent application Ser. No. 11/272,439, also filed Nov. 10, 2005, now U.S. Pat. No. 7,776,256, issued Aug. 17, 2010. By way of example and not limitation, the particle-matrix composite material 120 may comprise a plurality of hard particles dispersed throughout a matrix material. In some embodiments, the hard particles may comprise a material selected from diamond, boron carbide, boron nitride, aluminum nitride, and carbides or borides of the group consisting of W, Ti, Mo, Nb, V, Hf, Zr, Si, Ta, and Cr, and the matrix material may be selected from the group consisting of iron-based alloys, nickel-based alloys, cobalt-based alloys, titanium-based alloys, aluminum-based alloys, iron and nickel-based alloys, iron and cobalt-based alloys, and nickel and cobalt-based alloys. As used herein, the term "[metal]-based alloy" (where [metal] is any metal) means commercially pure [metal] in addition to metal alloys wherein the weight percentage of [metal] in the alloy is greater than or equal to the weight percentage of all other components of the alloy individually.

Furthermore, the earth-boring rotary drill bit 100 may be formed from two or more, less than fully sintered components (i.e., green or brown components) that may be sinter-bonded together to form at least a portion of the drill bit 100. During sintering of two or more less than fully sintered components (i.e., green or brown components), the two or more components will bond together. Additionally, when sintering the two or more less than fully sintered components together, the relative shrinkage rates of the two or more components may be tailored such that during sintering a first component and at least a second component will shrink essentially the same or a first component will shrink more than at least a second component. By tailoring the sinter-shrink rates such that a first component will have a greater shrinkage rate than the at least a second component, the components may be configured such that during sintering the at least a second component is at least partially surrounded and captured as the first component contracts upon it, thereby facilitating a complete sinterbond between the first and at least second components. The sinter-shrink rates of the two or more components may be tailored by controlling the porosity of the less than fully sintered components. Thus, forming a first component with more porosity than at least a second component may cause the first component to have a greater sinter-shrink rate than the at least a second component having less porosity.

The porosity of the components may be tailored by modifying one or more of the following non-limiting variables: particle size and size distribution, particle shape, pressing method, compaction pressure, and the amount of binder used when forming the less than fully sintered components.

Particles that are all the same size may be difficult to pack efficiently. Components formed from particles of the same size may include large pores and a high volume percentage of porosity. On the other hand, components formed from particles with a broad range of sizes may pack efficiently and minimize pore space between adjacent particles. Thus, porosity and therefore the sinter-shrink rates of a component may be controlled by the particle size and size distribution of the hard particles and matrix material used to form the component.

The pressing method may also be used to tailor the porosity of a component. Specifically, one pressing method may lead to tighter packing and therefore less porosity. As a non-limiting example, substantially isostatic pressing methods may produce tighter packed particles in a less than fully sintered component than uniaxial pressing methods and therefore less porosity. Therefore, porosity and the sinter-shrink rates of a component may be controlled by the pressing method used to form the less than full sintered component.

Additionally, compaction pressure may be used to control the porosity of a component. The greater the compaction pressure used to form the component the lesser amount of porosity the component may exhibit.

Finally, the amount of binder used in the components relative to the powder mixture may vary which affects the porosity of the powder mixture when the binder is burned from the powder mixture. The binder used in any powder mixture includes commonly used additives when pressing powder mixtures such as, for example, binders for providing lubrication during pressing and for providing structural strength to the pressed powder component, plasticizers for making the binder more pliable, and lubricants or compaction aids for reducing inter-particle friction.

The shrink rate of a particle-matrix material component is independent of composition. Therefore, varying the composition of the first component and the at least second components may not cause a difference in relative sinter-shrink rates. However, the composition of the first and the at least second components may be varied. In particular, the composition of the components may be varied to provide a difference in wear resistance or fracture toughness between the components. As a non-limiting example, a different grade of carbide may be used to form one component so that it exhibits greater wear resistance and/or fracture toughness relative to the component to which it is sinterbonded.

In some embodiments, the first component and at least a second component may comprise green body structures. In other embodiments, the first component and the at least a second component may comprise brown components. In yet additional embodiments, one of the first component and the at least a second component may comprise a green body component and the other a brown body component.

Recently, new methods of forming cutting element pockets by using a rotating cutter to machine a cutting element pocket in such a way as to avoid mechanical tool interference problems and forming the pocket so as to sufficiently support a cutting element therein have been investigated. Such methods are disclosed in U.S. patent application Ser. No. 11/838,008, filed Aug. 13, 2007, now U.S. Pat. No. 7,836,980, issued Nov. 23, 2010, the entire disclosure of which is incorporated by reference herein. Such methods may include machining a first recess in a bit body of an earth-boring tool to define a lateral sidewall surface of a cutting element pocket, machining a second recess to define at least a portion of a shoulder at an intersection with the first recess, and disposing a plug within the second recess to define at least a portion of an end surface of the cutting element pocket.

According to some embodiments of the present invention, the plug as disclosed by the previously referenced U.S. patent application Ser. No. 11/838,008, filed Aug. 13, 2007, now U.S. Pat. No. 7,836,980, issued Nov. 23, 2010, may be sinterbonded within the second recess to form a unitary bit body. More particularly, the sinter-shrink rates of the plug and the bit body surrounding it may be tailored so the bit body at least partially surrounds and captures the plug during co-sintering to facilitate a complete sinterbond.

Figure 5:
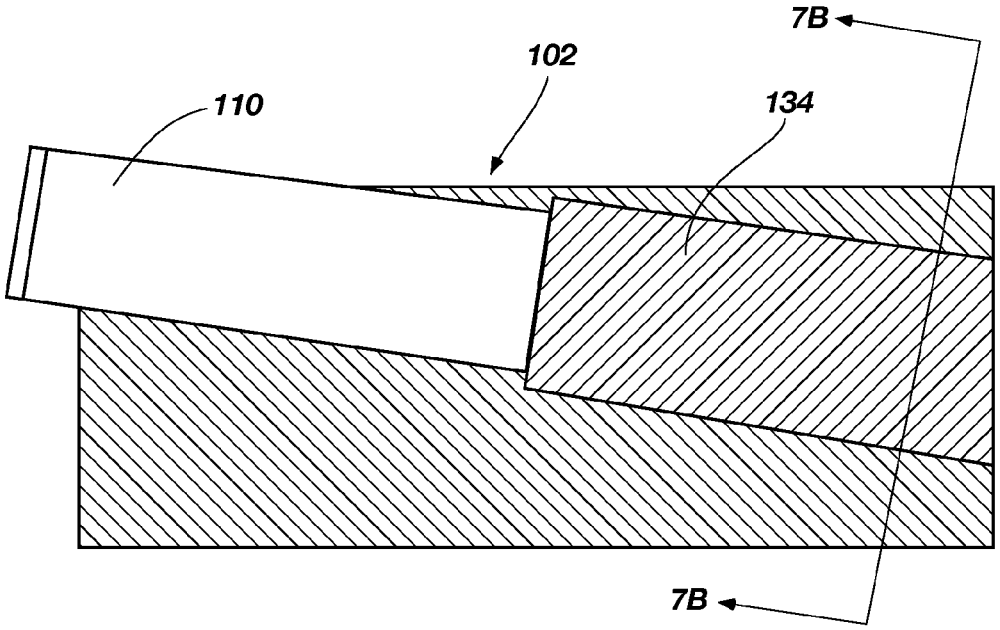
FIG. 5 is a side, partial cross-sectional view of the earth-boring rotary drill bit shown in FIG. 3 taken along the section line 5-5 shown therein, which includes a plug sinterbonded within a recess of a cutting element pocket.
Figure 6:
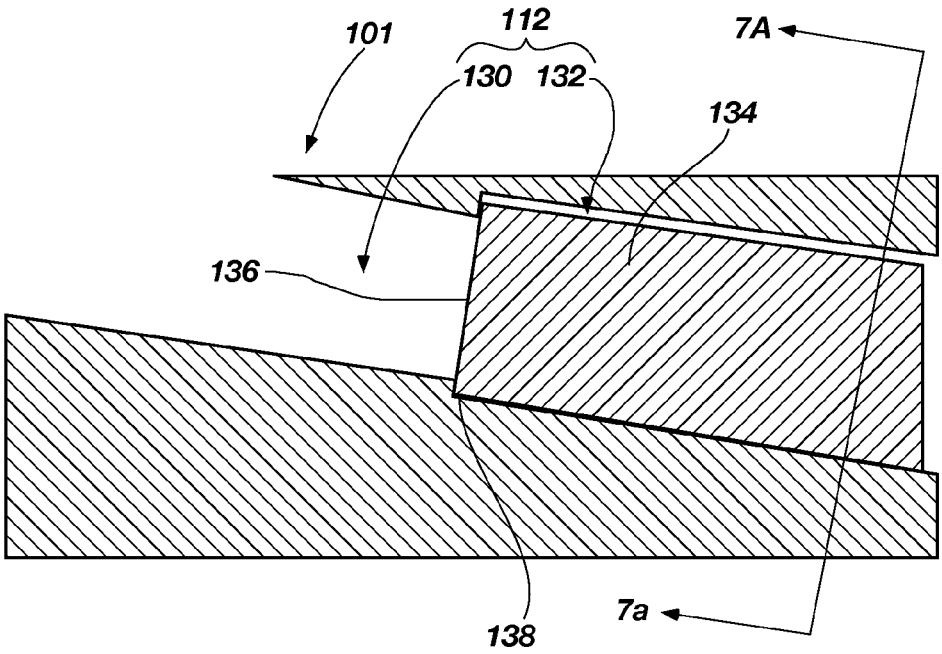
FIG. 6 is a side, partial cross-sectional view like that of FIG. 5 illustrating a less than fully sintered bit body and a less than fully sintered plug that may be co-sintered to a desired final density to form the earth-boring rotary drill bit shown in FIG. 5.

FIG. 5 is a side, partial cross-sectional view of the bit body 102 shown in FIG. 3 taken along the section line 5-5 shown therein. FIG. 6 is side, partial cross-sectional view of a less than fully sintered bit body 101 (i.e., a green or brown bit body) that may be sintered to a desired final density to form the bit body 102 shown in FIG. 5. As shown in FIG. 6, the bit body 101 may comprise a cutting element pocket 112 as defined by first and second recesses 130, 132 formed according to the methods of the previously mentioned U.S. patent application Ser. No. 11/838,008, filed Aug. 13, 2007, now U.S. Pat. No. 7,836,980, issued Nov. 23, 2010. A plug 134 may be disposed in the second recess 132 and may be placed so that at least a portion of a leading face 136 of the plug 134 may abut against a shoulder 138 between the first and second recesses 130, 132. At least a portion of the leading face 136 of the plug 134 may be configured to define the back surface (e.g., rear wall) of the cutting element pocket 112 against which a cutting element 110 may abut and rest. The plug 134 may be used to replace the excess material removed from the bit body 101 when forming the first recess 130 and the second recess 132, and to fill any portion or portions of the first recess 130 and the second recess 132 that are not comprised by the cutting element pocket 112.

Both the plug 134 and the bit body 102 may comprise particle-matrix composite components formed from any of the materials described hereinabove in relation to particle-matrix composite material 120. In some embodiments, the plug 134 and the bit body 101 may both comprise green powder components. In other embodiments, the plug 134 and the bit body 101 may both comprise brown components. In yet additional embodiments, one of the plug 134 and the bit body 101 may comprise a green body and the other a brown body. The sinter-shrink rate of the plug 134 and the bit body 101 may be tailored as desired as discussed herein. For instance, the sinter-shrink rate of the plug 134 and the bit body 101 may be tailored so the bit body 101 has a greater sinter-shrink rate than the plug 134. The plug 134 may be disposed within the second recess 132 as shown in FIG. 6, and the plug 134 and the bit body 101 may be co-sintered to a final desired density to sinterbond the less than full sintered bit body 101 to the plug 134 to form the unitary bit body 102 shown in FIG. 5. As mentioned previously, the sinter-shrink rates of the plug 134 and the bit body 101 may be tailored by controlling the porosity of each so the bit body 101 has a greater porosity than the plug 134 such that during sintering the bit body 101 will shrink more than the plug 134. The porosity of the bit body 101 and the plug 134 may be tailored by modifying one or more of the particle size and size distribution, pressing method, compaction pressure, and the amount of the binder used in a component when forming the less than fully sintered components as described hereinabove.

Figure 7A:
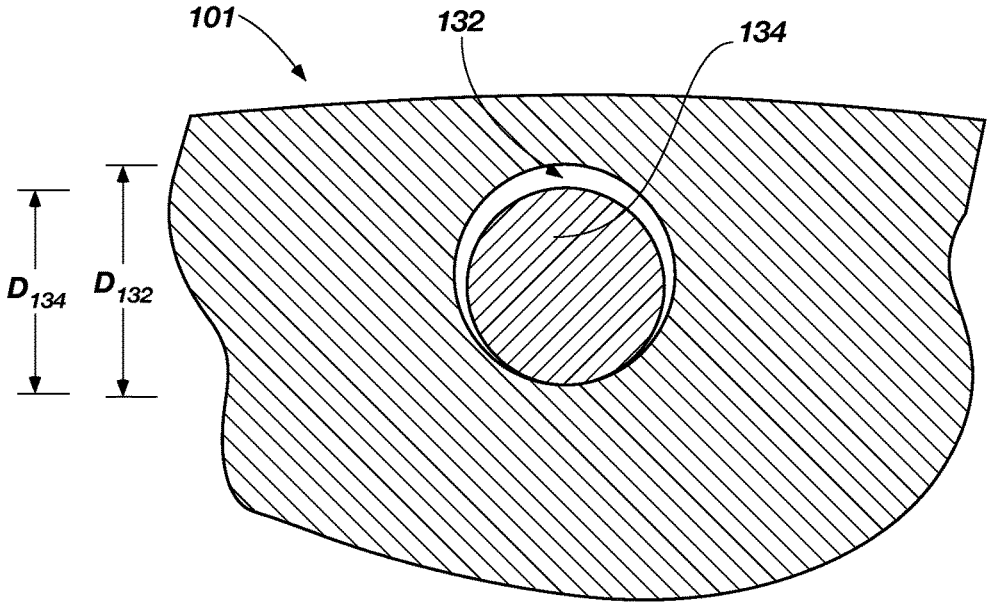
FIG. 7A is a cross-sectional view of the bit body and plug shown in FIG. 6 taken along section line 7A-7A shown therein.
Figure 7B:
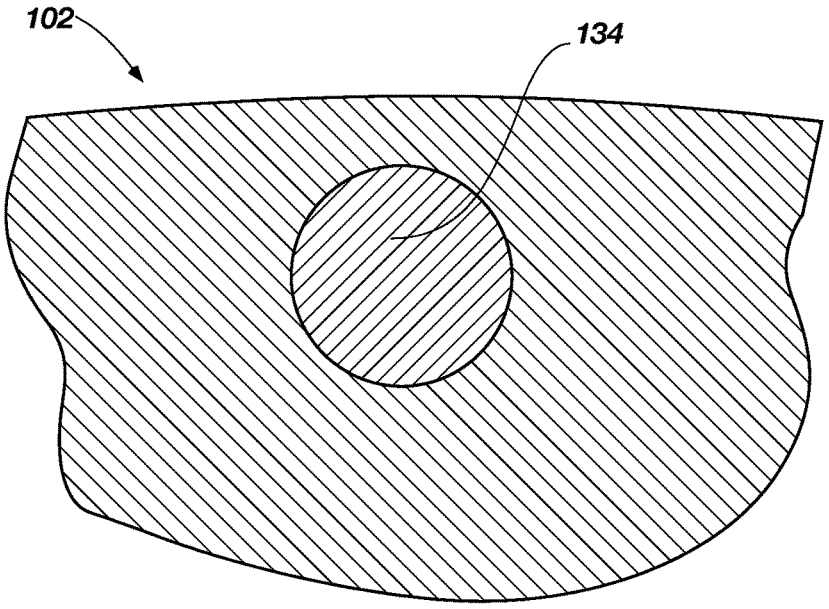
FIG. 7B is a cross-sectional view of the bit body shown in FIG. 5 taken along the section line 7B-7B shown therein that may be formed by sintering the bit body and the plug shown in FIG. 7A to a final desired density.

FIG. 7A is a cross-sectional view of the bit body 101 shown in FIG. 6 taken along section line 7A-7A shown therein. In some embodiments, as shown in FIG. 7A, a diameter $D_{132}$ of the second recess 132 of the cutting element pocket 112 may be larger than a diameter $D_{134}$ of the plug 134. The difference in the diameters of the second recess 132 and the plug 134 may allow the plug 134 to be easily placed within the second recess 132. FIG. 7B is a cross-sectional view of the bit body 102 shown in FIG. 5 taken along the section line 7B-7B shown therein and may be formed by sintering the bit body 101 and the plug 134 as shown in FIG. 7A to a final desired density. As shown in FIG. 7B, after sintering the bit body 101 and the plug 134 to a final desired density, any gap between the second recess 132 and the plug 134 created by the difference between the diameters $D_{132}$, $D_{134}$ of the second recess 132 and the plug 134 may be eliminated as the bit body 101 shrinks around and captures the plug 134 during co-sintering. Thus, because the bit body 101 has a greater sinter-shrink rate than the plug 134 and shrinks around and captures the plug 134 during sintering, a complete sinterbond along the entire interface between the plug 134 and the bit body 101 may be formed despite any gap between the second recess 132 and the plug 134 prior to co-sintering.

After co-sintering the plug 134 and the bit body 101 to a final desired density as shown in FIGS. 6 and 7B, the bit body 102 and the plug 134 may form a unitary structure. In other words, coalescence and bonding may occur between adjacent particles of the particle-matrix composite materials of the plug 134 and the bit body 101 during co-sintering. By co-sintering the plug 134 and the bit body 101 and forming a sinterbond therebetween, the bit body 102 may exhibit greater strength than a bit body formed from a plug that has been welded or brazed therein using conventional bonding methods.

Figure 8:
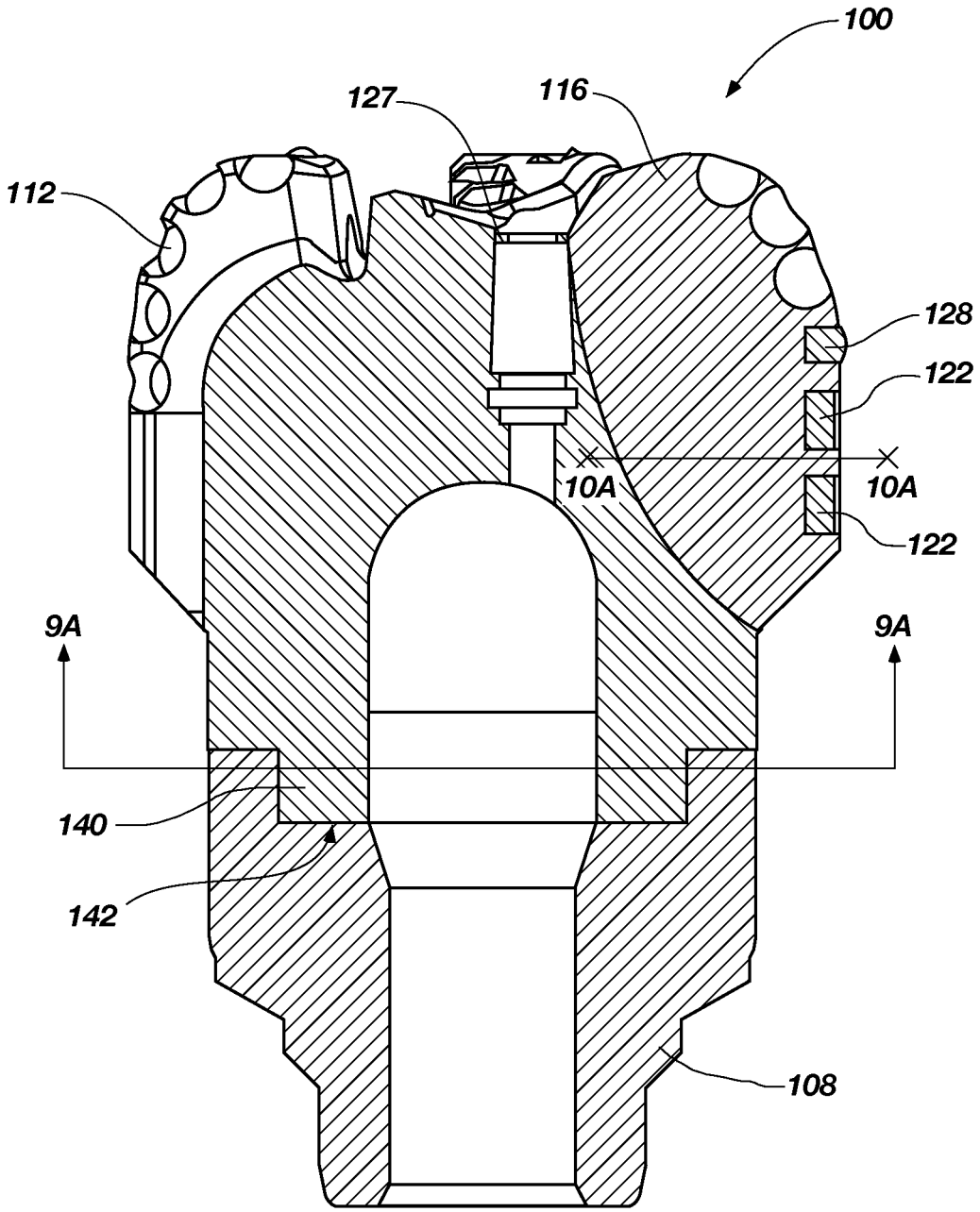
FIG. 8 is a longitudinal cross-sectional view of the earth-boring rotary drill bit shown in FIGS. 3 and 4 taken along the section line 8-8 shown in FIG. 4 that includes several particle-matrix components that have been sinterbonded together according to teachings of the present invention.

FIG. 8 is a longitudinal cross-sectional view of the earth-boring rotary drill bit 100 shown in FIGS. 3 and 4 taken along the section line 8-8 shown in FIG. 4. The earth-boring rotary drill bit 100 shown in FIG. 8 does not include cutting elements 110, nozzle inserts 124, or a shank 104. As shown in FIG. 8, the earth-boring rotary drill bit 100 may comprise one or more particle-matrix components that have been sinterbonded together to form the earth-boring rotary drill bit 100. In particular, the earth-boring rotary drill bit 100 may comprise an extension 108 that will be sinterbonded to the bit body 102, a blade 116 that may be sinterbonded to the bit body 102, cutting structures 146 that may be sinterbonded to the blade 116, and nozzle exit rings 127 that may be sinterbonded to the bit body 102 all using methods of the present invention in a manner similar to those described above in relation to the plug 134 and the bit body 102. The sinterbonding of the extension 108 and the bit body 102 is described hereinbelow in relation to FIGS. 9A and 9B; the sinterbonding of the blade 116 to the bit body 102 is described hereinbelow in relation to FIGS. 10A-B; the sinterbonding of the cutting structures 146 to the blade 116 is described hereinbelow in relation to FIGS. 11A and 11B; and the sinterbonding of the nozzle exit ring 127 to the bit body 102 is described herein below in relation to FIGS. 12A and 12B.

Figure 8A:
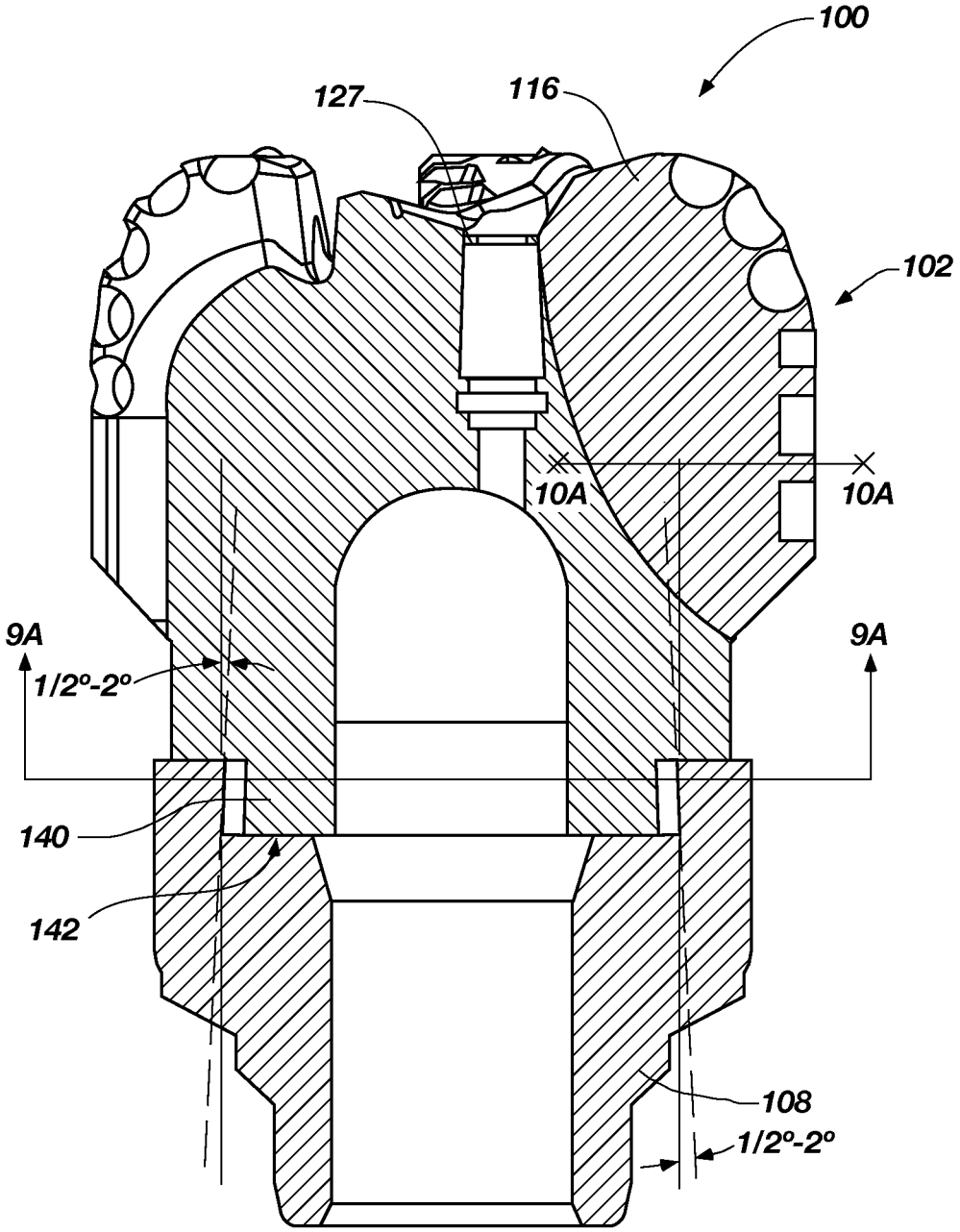
FIG. 8A is a longitudinal cross-sectional view of the earth-boring rotary drill bit shown in FIGS. 3 and 4 taken along the section line 8-8 shown in FIG. 4 that includes several particle-matrix components that have been sinterbonded together according to teachings of the present invention.

FIG. 8A is another longitudinal cross-sectional view of the earth-boring rotary drill bit 100 shown in FIGS. 3 and 4 taken along the section line 8-8 shown in FIG. 4. The earth-boring rotary drill bit 100 shown in FIG. 8 does not include cutting elements 110, nozzle inserts 124, or a shank 104. As shown in FIG. 8A, the earth-boring rotary drill bit 100 may comprise one or more particle-matrix components that will be or are sinterbonded together to form the earth-boring rotary drill bit 100. In particular, the earth-boring rotary drill bit 100 may comprise an extension 108 that will be sinterbonded to the previously finally sintered bit body 102, a blade 116 that has been sinterbonded to the bit body 102, cutting structures 146 that have been sinterbonded to the blade 116, and nozzle exit rings 127 that have been sinterbonded to the bit body 102 all using methods of the present invention in a manner similar to those described above in relation to the plug 134 and the bit body 102. The sinterbonding of the extension 108 and the bit body 102 occurs after the final sintering of the bit body 102 such as described herein when it is desired to have the shrinking of the extension to attach the extension 108 to the bit body 102. In general, after sinterbonding, the bit body 102 and the extension 108 are illustrated in relation to FIGS. 8B-8C. The extension 108 may be formed having a taper of approximately ½° to approximately 2°, as illustrated, while the bit body 102 may be formed having a mating taper of approximately ½° to approximately 2°, as illustrated, so that after the sinterbonding of the extension 108 to the bit body 102 the mating tapers of the extension 108 and the bit body 102 have formed an interference fit therebetween.

Figure 8C:
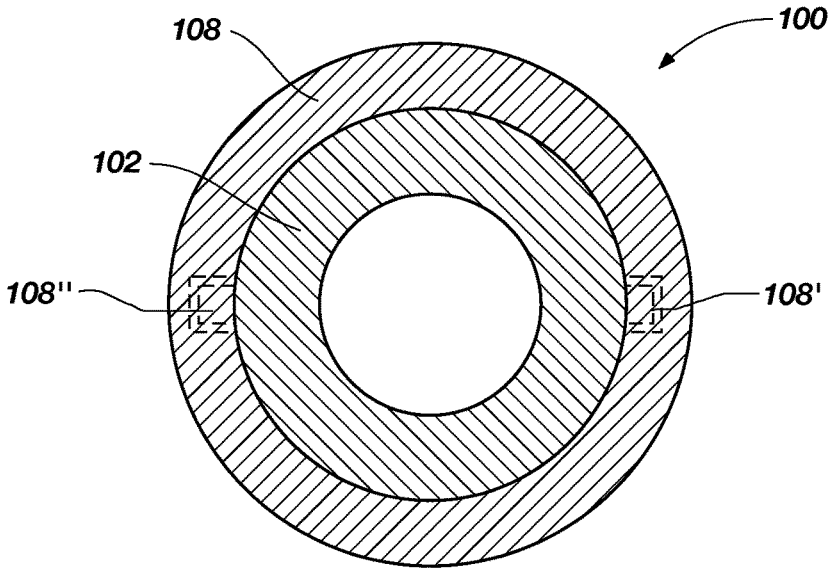
FIG. 8C is a cross-sectional view, similar to the cross-sectional view shown in FIG. 8B, illustrating a fully sintered bit body and a less than fully sintered extension that may be sintered to a desired final density to form the earth-boring rotary drill bit shown in FIG. 8B.
Figure 8B:
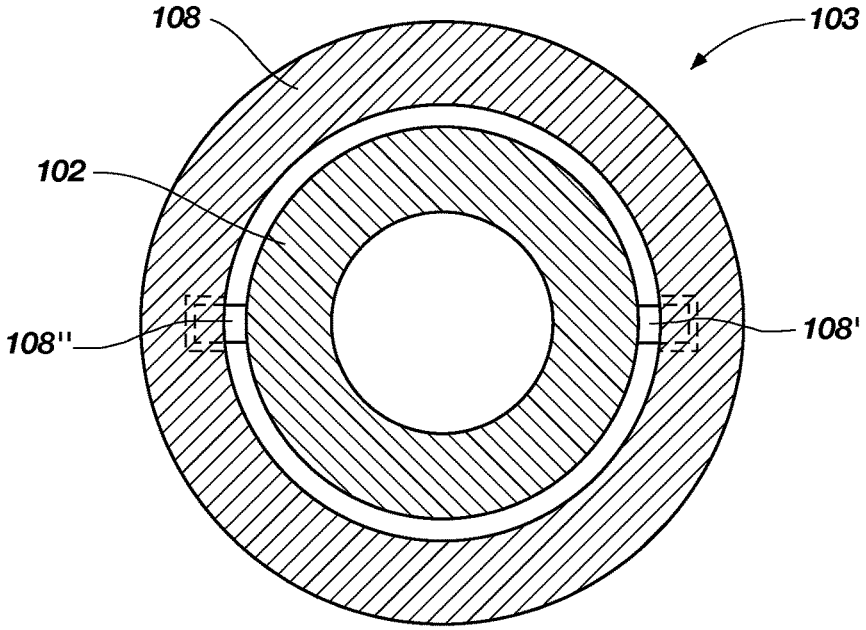
FIG. 8B is a cross-sectional view of the earth-boring rotary drill bit shown in FIG. 8A taken along section line 9A-9A shown therein that includes a less than fully sintered extension to be sinterbonded to a fully sintered bit body.

FIG. 8B is a cross-sectional view of the earth-boring rotary drill bit 100 shown in FIG. 8 taken along the section line 9A-9A shown therein. FIG. 8C is a cross-sectional view of a fully sintered earth-boring rotary drill bit 102, similar to the cross-sectional view shown in FIG. 8B, that has been sintered to a final desired density to form the earth-boring rotary drill bit body 102 shown in FIG. 8A. As shown in FIG. 8B, the earth-boring rotary drill bit 100 comprises a fully sintered bit body 102 and a less than fully sintered extension 108. The fully sintered bit body 102 and the less than fully sintered extension 108 may both comprise particle-matrix composite components. In some embodiments, both the fully sintered bit body 102 and the less than fully sintered extension 108 may comprise particle-matrix composite components formed from a plurality of tungsten carbide particles dispersed throughout a cobalt matrix material. In other embodiments, the less than fully sintered extension 108 and the fully sintered bit body 102 may comprise any of the materials described hereinabove in relation to particle-matrix composite material 120.

Furthermore, in some embodiments the fully sintered bit body 102 and less than fully sintered extension 108 may exhibit different material properties. As non-limiting examples, the fully sintered bit body 102 may comprise a tungsten carbide material with greater fracture toughness or wear resistance than a tungsten carbide material used to form the less than fully sintered extension 108.

The sinter-shrink rates of the fully sintered bit body 102, although a fully sintered bit body 102 essentially has no sinter-shrink rate after being fully sintered, and the less than fully sintered extension 108 may be tailored by controlling the porosity of each so the extension 108 has a greater porosity than the bit body 102 such that during sintering the extension 108 will shrink more than the fully sintered bit body 102. The porosity of the bit body 102 and the extension 108 may be tailored by modifying one or more of the particle size and size distribution, particle shape, pressing method, compaction pressure, and the amount of the binder used in a component when forming the less than fully sintered components as described hereinabove. Suitable types of connectors, such as lugs and recesses 108' or keys and recesses 108" (illustrated in dashed lines in FIGS. 8B and 8C) may be used as desired between the bit body 102 and extension 108.

Figure 9A:
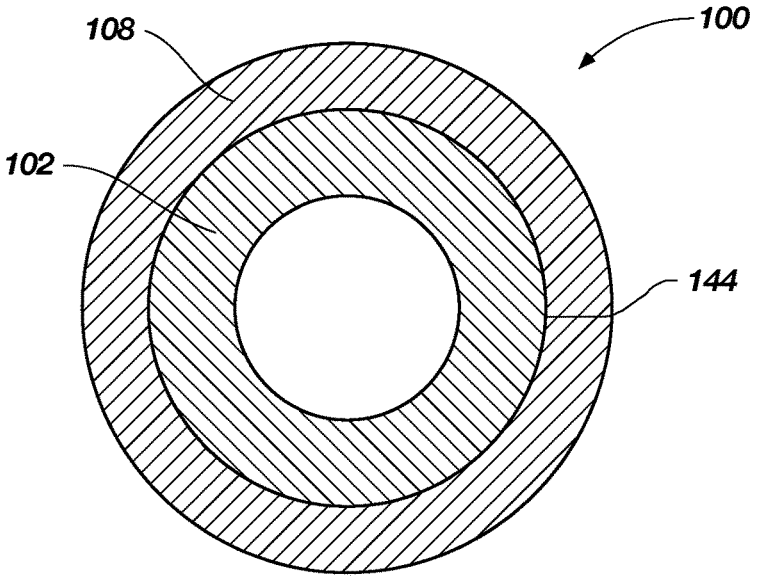
FIG. 9A is a cross-sectional view of the earth-boring rotary drill bit shown in FIG. 8 taken along section line 9A-9A shown therein that includes an extension sinter-bonded to a bit body.
Figure 9B:
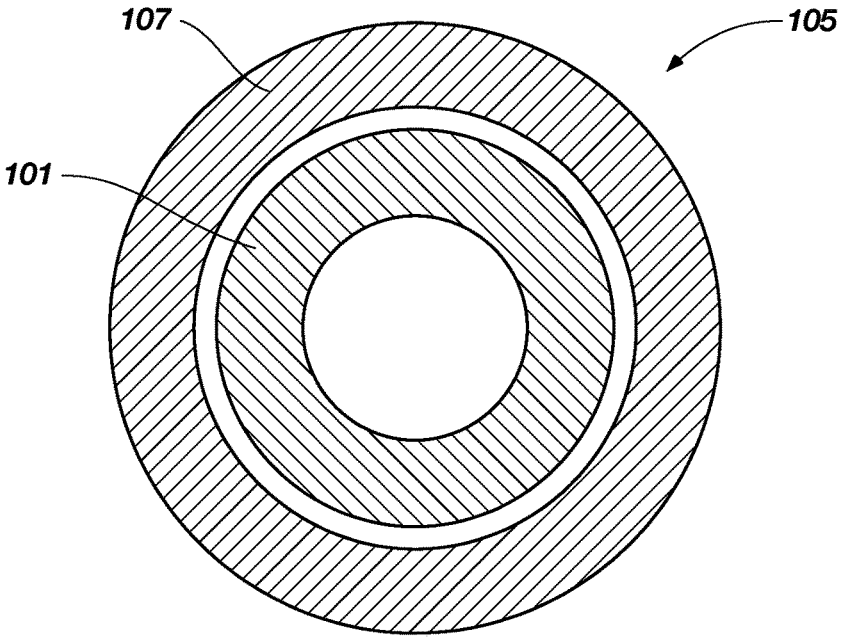
FIG. 9B is a cross-sectional view, similar to the cross-sectional view shown in FIG. 9A, illustrating a less than fully sintered bit body and a less than fully sintered extension that may be co-sintered to a desired final density to form the earth-boring rotary drill bit shown in FIG. 9A.

FIG. 9A is a cross-sectional view of the earth-boring rotary drill bit 100 shown in FIG. 8 taken along the section line 9A-9A shown therein. FIG. 9B is a cross-sectional view of a less than full sintered (i.e., a green or brown bit body) earth-boring rotary drill bit 105, similar to the cross-sectional view shown in FIG. 9A, that may be sintered to a final desired density to form the earth-boring rotary drill bit 100 shown in FIG. 9A. As shown in FIG. 9B, the earth-boring rotary drill bit 105 may comprise a less than fully sintered bit body 101 and a less than fully sintered extension 107. The less than fully sintered bit body 101 and the less than fully sintered extension 107 may both comprise particle-matrix composite components. In some embodiments, both the less than fully sintered bit body 101 and the less than fully sintered extension 107 may comprise particle-matrix composite components formed from a plurality of tungsten carbide particles dispersed throughout a cobalt matrix material. In other embodiments, the less than fully sintered extension 107 and the less than fully sintered bit body 101 may comprise any of the materials described hereinabove in relation to particle-matrix composite material 120.

Furthermore, in some embodiments the less than fully sintered bit body 101 and less than fully sintered extension 107 may exhibit different material properties. As non-limiting examples, the less than fully sintered bit body 101 may comprise a tungsten carbide material with greater fracture toughness or wear resistance than a tungsten carbide material used to form the less than fully sintered extension 107.

The sinter-shrink rates of the less than fully sintered bit body 101 and the less than fully sintered extension 107 may be tailored by controlling the porosity of each so the extension 107 has a greater porosity than the bit body 101 such that during sintering the extension 107 will shrink more than the bit body 101. The porosity of the bit body 101 and the extension 107 may be tailored by modifying one or more of the particle size and size distribution, pressing method, compaction pressure, and the amount of the binder used in a component when forming the less than fully sintered components as described hereinabove.

As mentioned previously, the extension 107 and the bit body 101, as shown in FIG. 9B, may be co-sintered to a final desired density to form the earth-boring rotary drill bit 100 shown in FIG. 9A. In particular, a portion 140 (FIG. 8) of the bit body 101 may be disposed at least partially within a recess 142 (FIG. 8) of the extension 107 and the extension 107 and the bit body 101 may be co-sintered. Because the extension 107 has a greater sinter-shrink rate than the bit body 101, the extension 107 may contract around the bit body 101 facilitating a complete sinterbond along an interface 144 therebetween, as shown in FIG. 9A.

Figure 10A:
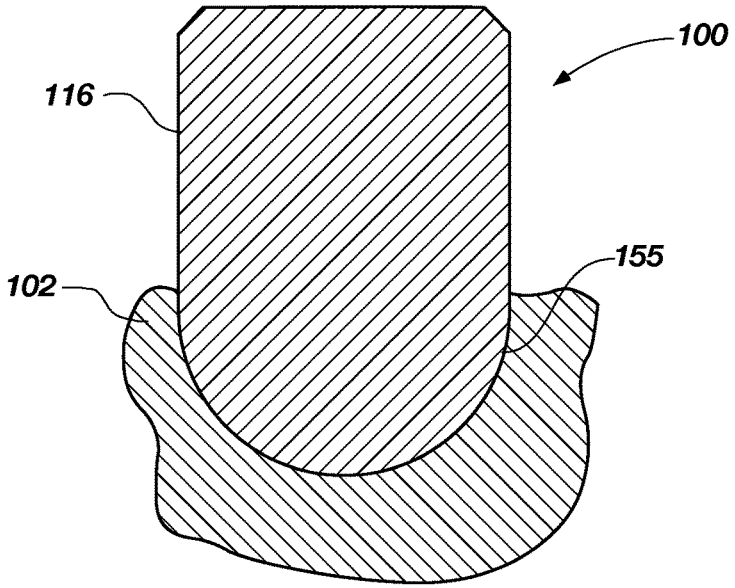
FIG. 10A is a cross-sectional view of the earth-boring rotary drill bit shown in FIG. 8 taken along section line 10A-10A shown therein that includes a blade sinterbonded to a bit body.
Figure 10B:
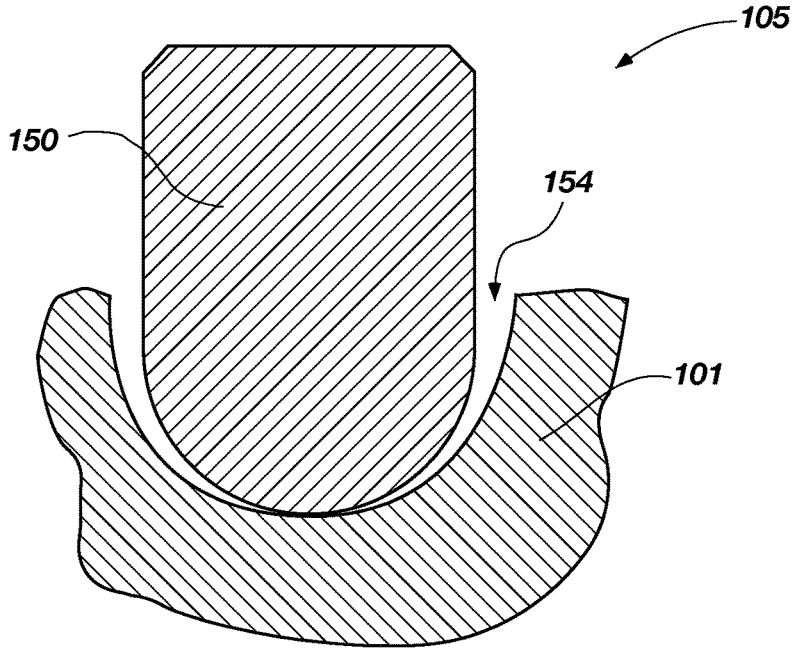
FIG. 10B is a cross-sectional view, similar to the cross-sectional view shown in FIG. 10A, illustrating a less than fully sintered bit body and a less than fully sintered blade that may be co-sintered to a desired final density to form the earth-boring rotary drill bit shown in FIG. 10A.

FIG. 10A is a cross-sectional view of the earth-boring rotary drill bit 100 shown in FIG. 8 taken along the section line 10A-10A shown therein. FIG. 10B is a cross-sectional view of a less than fully sintered (i.e., a green or brown bit body) earth-boring rotary drill bit 105, similar to the cross-sectional view shown in FIG. 10A, that may be sintered to a final desired density to form the earth-boring rotary drill bit 100 shown in FIG. 10A. As shown in FIG. 10B, the earth-boring rotary drill bit 105 may comprise a less than fully sintered bit body 101 and a less than fully sintered blade 150. The less than fully sintered bit body 101 and the less than fully sintered blade 150 may both comprise particle-matrix composite components. In some embodiments, both the less than fully sintered bit body 101 and the less than fully sintered blade 150 may comprise particle-matrix composite components formed from a plurality of tungsten carbide particles dispersed throughout a cobalt matrix material. In other embodiments, the less than fully sintered blade 150 and the less than fully sintered bit body 101 may comprise any of the materials described hereinabove in relation to particle-matrix composite material 120.

Furthermore, in some embodiments the less than fully sintered bit body 101 and less than fully sintered blade 150 may exhibit different material properties. As non-limiting examples, the less than fully sintered blade 150 may comprise a tungsten carbide material with greater fracture toughness or wear resistance than a tungsten carbide material used to form the less than fully sintered bit body 101. As non-limiting examples, the binder content may be lowered or a different grade of carbide may be used to form the blade 150 so that it exhibits greater wear resistance and/or fracture toughness relative to the bit body 101. In other embodiments, the less than fully sintered bit body 101 and less than fully sintered blade 150 may exhibit similar material properties.

The sinter-shrink rates of the less than fully sintered bit body 101 and the less than fully sintered blade 150 may be tailored by controlling the porosity of each so the bit body 101 has a greater porosity than the blade 150 such that during sintering the bit body 101 will shrink more than the blade 150. The porosity of the bit body 101 and the blade 150 may be tailored by modifying one or more of the particle size and size distribution, pressing method, compaction pressure, and the amount of the binder used in a component when forming the less than fully sintered components as described hereinabove.

As mentioned previously, the blade 150 and the bit body 101, as shown in FIG. 10B, may be co-sintered to a final desired density to form the earth-boring rotary drill bit 100 shown in FIG. 10A. In particular, the blade 150 may be at least partially disposed within a recess 154 of the bit body 101 and the blade 150 and the bit body 101 may be co-sintered. Because the bit body 101 has a greater sinter-shrink rate than the blade 150, the bit body 101 may contract around the blade 150 facilitating a complete sinterbond along an interface 155 therebetween as shown in FIG. 10A.

Figure 13:
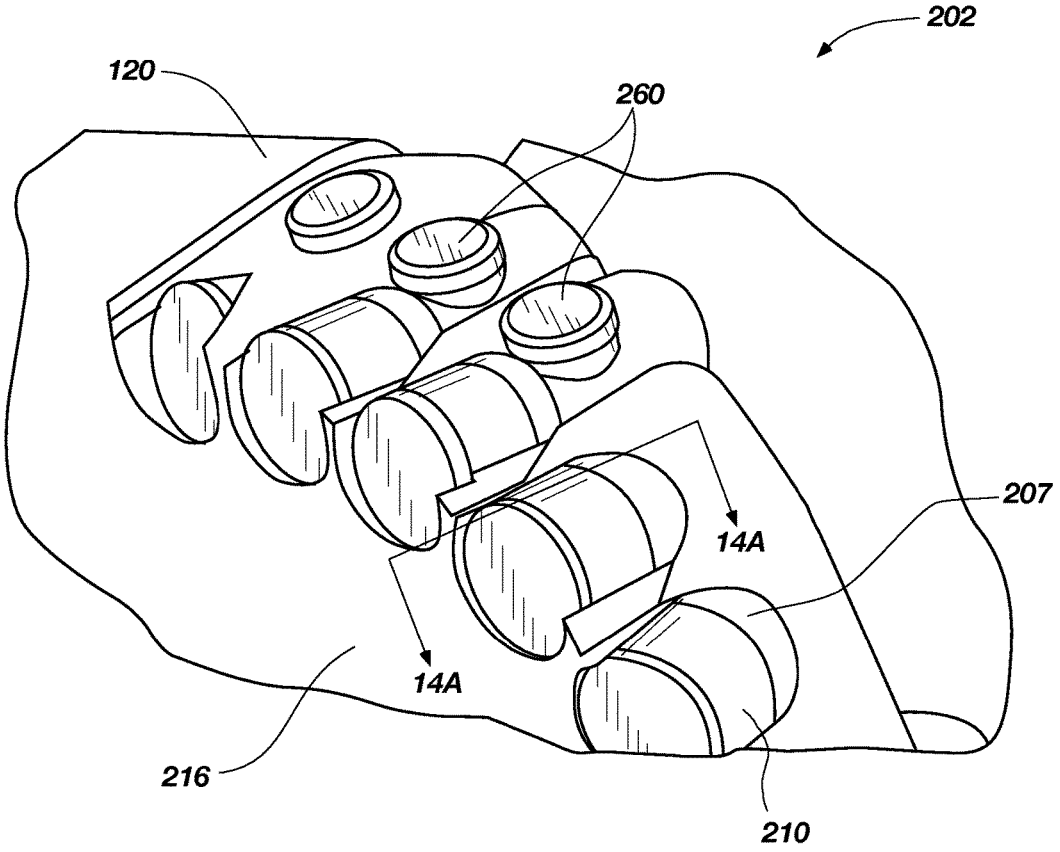
FIG. 13 is a partial perspective view of a bit body of another embodiment of an earth-boring rotary drill bit of the present invention, and more particularly of a blade of the bit body of an earth-boring rotary drill bit that includes buttresses that may be sinterbonded to the bit body.

Additionally as seen in FIG. 8, the earth-boring rotary drill bit 100 may include cutting structures 146 that may be sinterbonded to the bit body 102 and more particularly to the blades 116 using methods of the present invention. "Cutting structures" as used herein mean any structure of an earth-boring rotary drill bit configured to engage earth formations in a bore hole. For example, cutting structures may comprise wear knots 128, gage wear plugs 122, cutting elements 110 (FIG. 3), and BRUTE™ cutters 260 (Backup cutters that are Radially Unaggressive and Tangentially Efficient, illustrated in (FIG. 13).

Figure 11A:
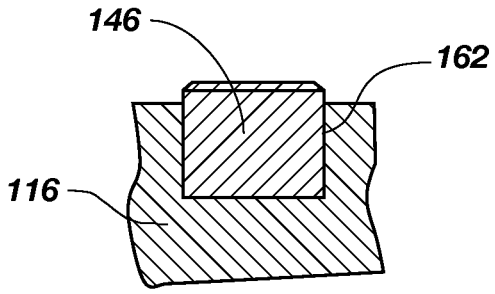
FIG. 11A is a partial cross-sectional view of a blade of an earth-boring rotary drill bit with a cutting structure sinter-bonded thereto using methods of the present invention.
Figure 11B:
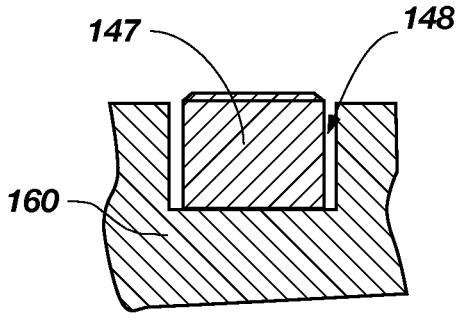
FIG. 11B is a partial cross-sectional view, similar to the partial cross-sectional view shown in FIG. 11A, illustrating a less than fully sintered blade of an earth-boring rotary drill bit and a less than fully sintered cutting structure that may be co-sintered to a desired final density to form the blade of the earth-boring rotary drill bit shown in FIG. 11A.

FIG. 11A is a partial cross-sectional view of a blade 116 of an earth-boring rotary drill bit with a cutting structure 146 sinterbonded thereto using methods of the present invention. FIG. 11B is a partial cross-sectional view of a less than fully sintered blade 160 of an earth-boring rotary drill bit, similar to the cross-sectional view shown in FIG. 11A, that may be sintered to a final desired density to form the blade 116 shown in FIG. 11A. As shown in FIG. 11B, a less than fully sintered cutting structure 147 may be disposed at least partially within a recess 148 of the less than fully sintered blade 160. The less than fully sintered cutting structure 147 and the less than fully sintered blade 160 may both comprise particle-matrix composite components. In some embodiments, both the less than fully sintered cutting structure 147 and the less than fully sintered blade 160 may comprise particle-matrix composite components formed from a plurality of tungsten carbide particles dispersed throughout a cobalt matrix material. In other embodiments, the less than fully sintered blade 160 and the less than fully sintered cutting structure 147 may comprise any of the materials described hereinabove in relation to particle-matrix composite material 120.

Furthermore, in some embodiments the less than fully sintered cutting structure 147 and less than fully sintered blade 160 may exhibit different material properties. As non-limiting examples, the less than fully sintered cutting structure 147 may comprise a tungsten carbide material with greater fracture toughness or wear resistance than a tungsten carbide material used to form the less than fully sintered blade 160. As non-limiting examples, the binder content may be lowered or a different grade of carbide may be used to form the less than fully sintered cutting structure 147 so that it exhibits greater wear resistance and/or fracture toughness relative to the blade 160. In other embodiments, the less than fully sintered cutting structure 147 and less than fully sintered blade 160 may exhibit similar material properties.

The sinter-shrink rates of the less than fully sintered cutting structure 147 and the less than fully sintered blade 160 may be tailored by controlling the porosity of each so the blade 160 has a greater porosity than the cutting structure 147 such that during sintering the blade 160 will shrink more than the cutting structure 147. The porosity of the cutting structure 147 and the blade 160 may be tailored by modifying one or more of the particle size and size distribution, pressing method, compaction pressure, and the amount of the binder used in a component when forming the less than fully sintered components as described hereinabove.

As mentioned previously, the blade 160 and the cutting structure 147, as shown in FIG. 11B, may be co-sintered to a final desired density to form the blade 116 shown in FIG. 11A. Because the blade 160 has a greater sinter-shrink rate than the cutting structure 147, the blade 160 may contract around the cutting structure 147 facilitating a complete sinterbond along an interface 162 therebetween as shown in FIG. 11A.

Figure 12A:
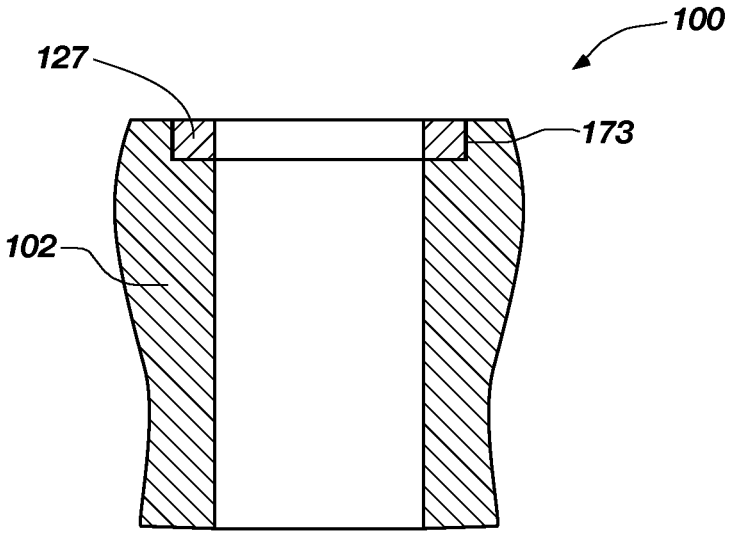
FIG. 12A is an enlarged partial cross-sectional view of the earth-boring rotary drill bit shown in FIG. 8 that includes a nozzle exit ring sinterbonded to a bit body.
Figure 12B:
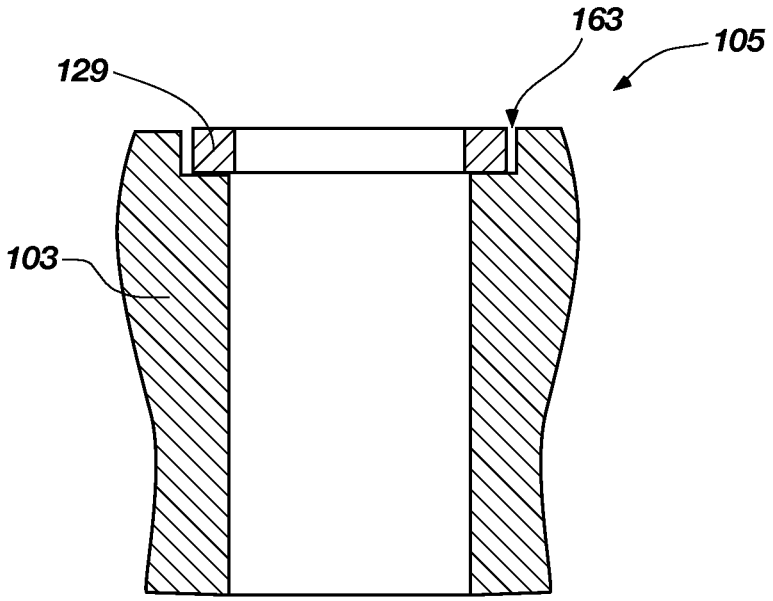
FIG. 12B is a cross-sectional view, similar to the cross-sectional view shown in FIG. 12A, of a less than full sintered earth-boring rotary drill bit that may be sintered to a final desired density to form the earth-boring rotary drill bit shown in FIG. 12A.

FIG. 12A is an enlarged partial cross-sectional view of the earth-boring rotary drill bit 100 shown in FIG. 8. FIG. 12B is a cross-sectional view of a less than fully sintered earth-boring rotary drill bit 105, similar to the cross-sectional view shown in FIG. 12A, that may be sintered to a final desired density to form the earth-boring rotary drill bit 100 shown in FIG. 12A. As shown in FIG. 12B, the earth-boring rotary drill bit 105 may comprise a less than fully sintered bit body 101 and a less than fully sintered nozzle exit ring 129. The less than fully sintered bit body 101 and the less than fully sintered nozzle exit ring 129 may both comprise particle-matrix composite components. In some embodiments, both the less than fully sintered bit body 101 and the less than fully sintered nozzle exit ring 129 may comprise particle-matrix composite components formed from a plurality of tungsten carbide particles dispersed throughout a cobalt matrix material. In other embodiments, the less than fully sintered nozzle exit ring 129 and the less than fully sintered bit body 101 may comprise any of the materials described hereinabove in relation to particle-matrix composite material 120.

Furthermore, in some embodiments the less than fully sintered bit body 101 and less than fully sintered nozzle exit ring 129 may exhibit different material properties. As non-limiting examples, the less than fully sintered nozzle exit ring 129 may comprise a tungsten carbide material with greater fracture toughness or wear resistance than a tungsten carbide material used to form the less than fully sintered bit body 101. As non-limiting examples, the binder content may be lowered or a different grade of carbide may be used to form the nozzle exit ring 129 so that it exhibits greater wear resistance and/or fracture toughness relative to the bit body 101. In other embodiments, the less than fully sintered bit body 101 and less than fully sintered nozzle exit ring 129 may exhibit similar material properties.

The sinter-shrink rates of the less than fully sintered bit body 101 and the less than fully sintered nozzle exit ring 129 may be tailored by controlling the porosity of each so the bit body 101 has a greater porosity than the nozzle exit ring 129 such that during sintering the bit body 101 will shrink more than the nozzle exit ring 129. The porosity of the bit body 101 and the nozzle exit ring 129 may be tailored by modifying one or more of the particle size and size distribution, pressing method, compaction pressure, and the amount of the binder used in a component when forming the less than fully sintered components as described hereinabove.

As mentioned previously, the nozzle exit ring 129 and the bit body 101, as shown in FIG. 12B, may be co-sintered to a final desired density to form the earth-boring rotary drill bit 100 shown in FIG. 11A. In particular, the nozzle exit ring 129 may be at least partially disposed within a recess 163 of the bit body 101 and the nozzle exit ring 129 and the bit body 101 may be co-sintered. Because the bit body 101 has a greater sinter-shrink rate than the nozzle exit ring 129, the bit body 101 may contract around the nozzle exit ring 129 facilitating a complete sinterbond along an interface 173 therebetween, as shown in FIG. 12A.

FIG. 13 is a partial perspective view of a bit body 202 of an earth-boring rotary drill bit, and more particularly of a blade 216 of the bit body 202, similar to the bit body 102 shown in FIG. 3. The bit body 202 may comprise a particle-matrix composite material 120 and may be formed using powder compaction and sintering processes, such as those previously described. As shown in FIG. 13, the bit body 202 may include a plurality of cutting elements 210 supported by buttresses 207. The bit body 202 may also include a plurality of BRUTE™ cutters 260.

Figure 14A:
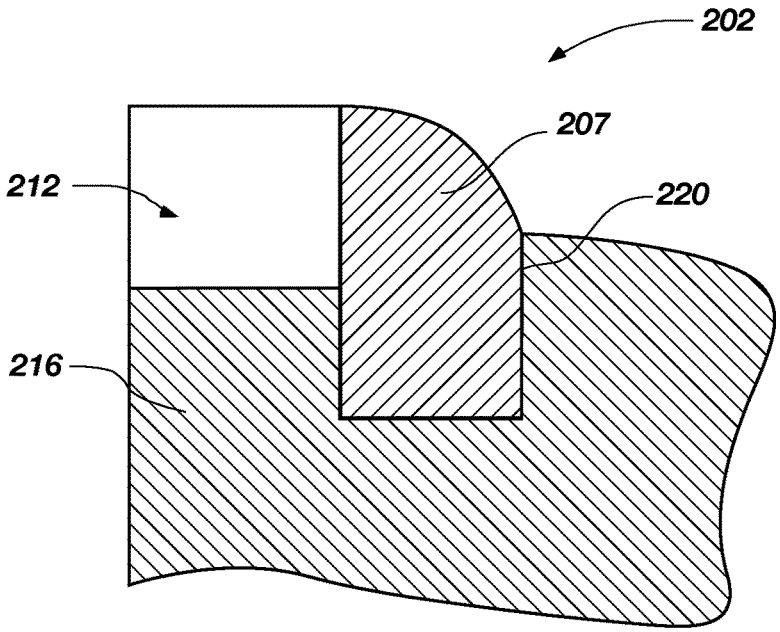
FIG. 14A is a partial cross-sectional view of the bit body shown in FIG. 13 taken along the section line 14A-14A shown therein that does not illustrate a cutting element 210.
Figure 14B:
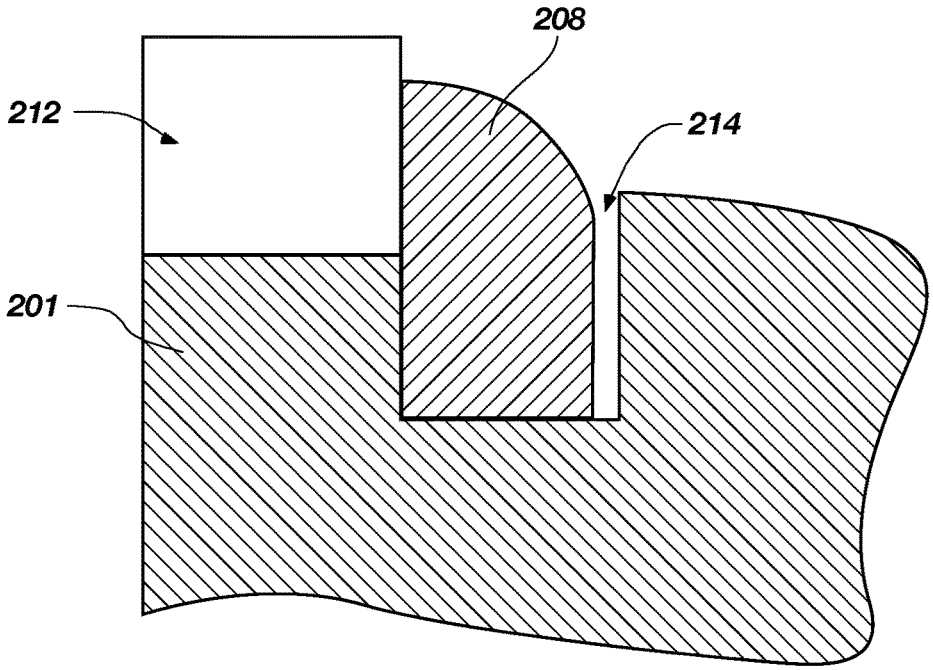
FIG. 14B is partial cross-sectional view, similar to the partial cross-sectional view shown in FIG. 14A, of a less than fully sintered bit body that may be sintered to a desired final density to form the bit body shown in FIG. 14A.

According to some embodiments of the present invention, the buttresses 207 may be sinterbonded to the bit body 202. FIG. 14A is a partial cross-sectional view of the bit body 202 shown in FIG. 13 taken along the section line 14A-14A shown therein. FIG. 14A, however, does not illustrate the cutting element 210. FIG. 14B is a less than fully sintered bit body 201 (i.e., a green or brown bit body) that may be sintered to a desired final density to form the bit body 202 shown in FIG. 14A. As shown in FIG. 14B, the less than fully sintered bit body 201 may comprise a cutting element pocket 212 and a recess 214 configured to receive a less than fully sintered buttress 208.

The less than fully sintered buttress 208 and the less than fully sintered bit body 201 may both comprise particle-matrix composite components. In some embodiments, both the less than fully sintered buttress 208 and the less than fully sintered bit body 201 may comprise particle-matrix composite components formed from a plurality of tungsten carbide particles dispersed throughout a cobalt matrix material. In other embodiments, the less than fully sintered bit body 201 and the less than fully sintered buttress 208 may comprise any of the materials described hereinabove in relation to particle-matrix composite material 120.

Furthermore, in some embodiments the less than fully sintered buttress 208 and less than fully sintered bit body 201 may exhibit different material properties. As non-limiting examples, the less than fully sintered buttress 208 may comprise a tungsten carbide material with greater fracture toughness or wear resistance than a tungsten carbide material used to form the less than fully sintered bit body 201. As non-limiting examples, the binder content may be lowered or a different grade of carbide may be used to form the less than fully sintered buttress 208 so that it exhibits greater wear resistance and/or fracture toughness relative to the bit body 201. In other embodiments, the less than fully sintered buttress 208 and less than fully sintered bit body 201 may exhibit similar material properties.

The sinter-shrink rates of the less than fully sintered buttress 208 and the less than fully sintered bit body 201 may be tailored by controlling the porosity of each so the bit body 201 has a greater porosity than the buttress 208 such that during sintering the bit body 201 will shrink more than the buttress 208. The porosity of the buttress 208 and the bit body 201 may be tailored by modifying one or more of the particle size, particle shape, and particle size distribution, pressing method, compaction pressure, and the amount of the binder used in a component when forming the less than fully sintered components as described hereinabove.

As mentioned previously, the bit body 201 and the buttress 208, as shown in FIG. 14B, may be co-sintered to a final desired density to form the bit body 202 shown in FIG. 14A. Because the bit body 201 has a greater sinter-shrink rate than the buttress 208, the bit body 201 may contract around the buttress 208 facilitating a complete sinterbond along an interface 220 therebetween as shown in FIG. 14A.

Although the methods of the present invention have been described in relation to fixed-cutter rotary drill bits, they are equally applicable to any bit body that is formed by sintering a less than fully sintered bit body to a desired final density. For example, the methods of the present invention may be used to form subterranean tools other than fixed-cutter rotary drill bits including, for example, core bits, eccentric bits, bicenter bits, reamers, mills, drag bits, roller cone bits, and other such structures known in the art.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors.

What is claimed is:

1. A method of forming an earth-boring rotary drill bit, comprising:

tailoring a sinter-shrink rate of a first component to be greater than a sinter-shrink rate of at least a second component, wherein the first component and the second component each comprise an organic binder material; and co-sintering the first component and the at least a second component to remove at least a portion of the organic binder material and to cause the first component to at least partially contract upon and bond to the at least a second component.

2. The method of claim 1, wherein tailoring a sinter-shrink rate of a first component to be greater than a sinter-shrink rate of a second component comprises selecting the first component and the second component to have at least one input parameter different from one another, the at least one input parameter selected from the group consisting of a particle size and size distribution, a pressing method, a compaction pressure, and a percentage of the organic binder material.

3. The method of claim 1, wherein tailoring a sinter-shrink rate of a first component to be greater than a sinter-shrink rate of at least a second component comprises selecting the first component to have a first porosity and selecting the second component to have a second porosity lower than the first porosity.

4. The method of claim 1, wherein tailoring a sinter-shrink rate of a first component to be greater than a sinter-shrink rate of at least a second component comprises uniaxially pressing the first component and isostatically pressing the second component.

5. The method of claim 1, wherein tailoring a sinter-shrink rate of a first component to be greater than a sinter-shrink rate of at least a second component comprises applying a first compaction pressure to the first component and applying a second compaction pressure to the second component, wherein the second compaction pressure is greater than the first compaction pressure.

6. The method of claim 1, wherein tailoring a sinter-shrink rate of a first component to be greater than a sinter-shrink rate of at least a second component comprises providing the first component having a first binder content and providing the second component having a second binder content, wherein the second binder content is greater than the first binder content.

7. The method of claim 1, further comprising varying a composition of the first component from a composition of the second component.

8. The method of claim 1, further comprising machining a recess in the first component.

9. The method of claim 8, further comprising disposing the second component within the recess.

10. A method of forming an earth-boring rotary drill bit, comprising:

disposing a first component adjacent a second component, wherein the first component and the second component each comprise a plurality of hard particles dispersed throughout a matrix material with an organic binder material, wherein the first component and the second component are each structured to form a portion of an earth-boring rotary drill bit, and wherein a sinter-shrink rate of the first component is greater than a sinter-shrink rate of the second component; and sintering the first component and the second component to remove at least a portion of the organic binder material and to cause the first component to contract and bond to the second component.

11. The method of claim 10, wherein the first component exhibits a first porosity and the second component exhibits a second porosity lower than the first porosity.

12. The method of claim 10, further comprising uniaxially pressing the first component and isostatically pressing the second component.

13. The method of claim 10, further comprising applying a first compaction pressure to the first component and applying a second compaction pressure to the second component, wherein the second compaction pressure is greater than the first compaction pressure.

14. The method of claim 10, wherein the first component has a first binder content and the second component has a second binder content greater than the first binder content.

15. The method of claim 10, wherein the first component has a composition different from a composition of the second component.

16. The method of claim 10, wherein disposing a first component adjacent a second component comprises disposing the second component within a recess in the first component.

17. A method of forming an earth-boring rotary drill bit, comprising:

providing a first component with a first sinter-shrink rate and having an organic binder material;

disposing at least a second component at least partially within at least a first recess defined by the first component, the at least a second component having a second sinter-shrink rate greater than zero and less than the first sinter-shrink rate; and at least substantially removing the organic binder material from the first component by co-sintering the first component and the at least a second component to cause the first component to shrink at least partially around and bond to the at least a second component.

18. The method of claim 17, wherein the first component comprises a green component and the second component comprises a brown component.

19. The method of claim 17, wherein disposing at least a second component at least partially within at least a first recess defined by the first component comprises disposing a tapered surface of the second component adjacent a tapered surface of the first component.

20. The method of claim 17, wherein at least substantially removing the organic binder material from the first component comprises fully sintering the first component.

* * * * *